US011542721B2

(12) United States Patent
Langenwalter et al.

(10) Patent No.: US 11,542,721 B2
(45) Date of Patent: Jan. 3, 2023

(54) PREFABRICATED MODULAR FENCING WITH ADVANTAGEOUSLY-SHAPED CONNECTORS

(71) Applicant: ORIGIN POINT BRANDS, LLC, Summerville, SC (US)

(72) Inventors: Duane E Langenwalter, Monroe, CT (US); Ning Xue, Newtown, CT (US)

(73) Assignee: ORIGIN POINT BRANDS, LLC, Summerville, SC (US)

( * ) Notice: Subject to any disclaimer, the term of this patent is extended or adjusted under 35 U.S.C. 154(b) by 173 days.

(21) Appl. No.: 17/158,403

(22) Filed: Jan. 26, 2021

(65) Prior Publication Data

US 2021/0381272 A1 Dec. 9, 2021

Related U.S. Application Data

(60) Provisional application No. 63/035,999, filed on Jun. 8, 2020.

(51) Int. Cl.
*E04H 17/18* (2006.01)
*E04H 17/14* (2006.01)
(Continued)

(52) U.S. Cl.
CPC ..... *E04H 17/185* (2021.01); *E04H 17/013* (2021.01); *E04H 17/143* (2013.01);
(Continued)

(58) Field of Classification Search
CPC ..... E04H 17/013; E04H 17/1447; E04H 17/1448; E04H 17/1473; E04H 17/1478;
(Continued)

(56) References Cited

U.S. PATENT DOCUMENTS 5,402,988 A 4/1995 Eisle
5,452,880 A 9/1995 Bailey
(Continued)

FOREIGN PATENT DOCUMENTS

CA 2176582 A1 5/1995
CA 2229886 A1 8/1998
(Continued)

OTHER PUBLICATIONS

Extended European Search Report re: application No. 21162957.1 dated Oct. 27, 2021.

*Primary Examiner* — Jonathan P Masinick
(74) *Attorney, Agent, or Firm* — Parker Poe Adams and Bernstein LLP

(57) ABSTRACT

A prefabricated modular fencing system comprises first and second fence panels, each panel having opposing side ends. Each side end carries outboard connectors. The connectors have upper sides defining one of a concavity and a convexity and have lower sides defining the other of a concavity and a convexity, and the connectors define a bore within each convexity. The convexity of a connector carried by the first fence panel may be complementary with and interfitted within the concavity of another connector carried by the second fence panel, to assemble the first and second fence panels together. A post is disposed through the bores of interfitted connectors.

24 Claims, 13 Drawing Sheets

(51) Int. Cl.
*E04H 17/00* (2006.01)
*E04H 17/16* (2006.01)
*E04H 17/22* (2006.01)

(52) U.S. Cl.
CPC ..... *E04H 17/1439* (2013.01); *E04H 17/1473* (2021.01); *E04H 17/166* (2013.01); *E04H 17/22* (2013.01)

(58) Field of Classification Search
CPC . E04H 17/1488; E04H 17/165; E04H 17/166; E04H 17/17; E04H 17/18; E04H 17/185
See application file for complete search history.

(56) References Cited

U.S. PATENT DOCUMENTS

| | | | | |
|---|---|---|---|---|
| 5,601,279 | A | 2/1997 | Schwartz | |
| 6,345,809 | B1 | 2/2002 | Bebendorg | |
| 6,581,661 | B1 | 6/2003 | Morrison et al. | |
| 6,588,732 | B1 | 7/2003 | Caceres | |
| 6,719,277 | B2 | 4/2004 | Ohanesian | |
| 6,779,782 | B1 * | 8/2004 | Webb | E04F 11/1817 256/65.01 |
| 6,824,123 | B2 | 11/2004 | Larsen | |
| 6,851,661 | B1 | 2/2005 | Penning | |
| 7,032,890 | B2 | 4/2006 | Svalbe | |
| 7,134,646 | B1 | 11/2006 | Brooks | |
| 7,562,865 | B2 | 7/2009 | Penning | |
| 7,676,926 | B2 | 3/2010 | Langenwalter | |
| 7,677,534 | B2 | 3/2010 | Langenwalter | |
| 8,152,141 | B2 | 4/2012 | Langenwalter | |
| 8,511,648 | B2 | 8/2013 | McCarthy | |
| 8,622,478 | B2 | 3/2014 | Jones | |
| 8,931,761 | B2 * | 1/2015 | Langenwalter | E04H 12/2215 256/25 |
| 9,458,645 | B1 | 10/2016 | King | |
| 9,482,028 | B2 | 11/2016 | Springborn | |
| 9,556,641 | B2 | 1/2017 | Milanowski | |
| 9,574,370 | B2 | 2/2017 | Presti | |
| 9,631,396 | B2 | 4/2017 | Leach | |
| 9,695,612 | B2 | 7/2017 | Batts | |
| 9,784,011 | B2 | 10/2017 | Walker | |
| 9,797,158 | B2 | 10/2017 | Springborn | |
| 9,932,753 | B1 | 4/2018 | Knudsen | |
| 9,988,825 | B1 | 6/2018 | Parks | |
| 10,087,651 | B2 | 10/2018 | Cavanagh | |
| 10,156,084 | B2 | 12/2018 | Garcia | |
| 10,167,653 | B1 | 1/2019 | Knudsen | |
| 10,202,804 | B2 | 2/2019 | Prasad | |
| 10,214,939 | B2 | 2/2019 | Guadalupe | |
| 10,364,589 | B2 | 7/2019 | Cochrane | |
| D858,798 | S | 9/2019 | McCarthy | |
| 10,458,147 | B2 | 10/2019 | Guadalupe | |
| 10,465,414 | B2 | 11/2019 | Calle | |
| D870,543 | S * | 12/2019 | Peyton | D8/382 |
| D873,439 | S | 1/2020 | McCarthy | |
| 10,538,939 | B1 | 1/2020 | Gibbs et al. | |
| D948,330 | S * | 4/2022 | Langenwalter | D8/396 |
| D951,082 | S * | 5/2022 | Langenwalter | D8/396 |
| 2002/0027225 | A1 | 3/2002 | Sotillos | |
| 2002/0175321 | A1 | 11/2002 | Larsen | |
| 2003/0030047 | A1 | 2/2003 | Ohanesian | |
| 2003/0146426 | A1 | 8/2003 | Ray | |
| 2004/0188667 | A1 | 9/2004 | Ray | |
| 2005/0023513 | A1 | 2/2005 | Penning | |
| 2005/0035341 | A1 | 2/2005 | Montgomery | |
| 2005/0056821 | A1 | 3/2005 | Kerr | |
| 2005/0173690 | A1 | 8/2005 | Penning | |
| 2005/0189530 | A1 | 9/2005 | Ohanesian | |
| 2006/0118772 | A1 | 6/2006 | Rosine | |
| 2008/0169455 | A1 | 7/2008 | Alberts | |
| 2009/0184301 | A1 | 7/2009 | Ian | |
| 2010/0207088 | A1 | 8/2010 | Bowman | |
| 2011/0073823 | A1 | 3/2011 | Mitrovic | |
| 2011/0114910 | A1 | 5/2011 | Stuckel | |
| 2011/0168963 | A1 | 7/2011 | Bowman | |
| 2013/0264532 | A1 | 10/2013 | Goodman | |
| 2014/0034890 | A1 | 2/2014 | Dixon | |
| 2015/0345173 | A1 | 12/2015 | Grasman | |
| 2017/0370120 | A1 | 12/2017 | Billings | |
| 2018/0094452 | A1 | 4/2018 | Loucks et al. | |
| 2018/0163429 | A1 | 6/2018 | Rosicki | |
| 2018/0238076 | A1 | 8/2018 | Theim | |
| 2018/0283042 | A1 | 10/2018 | Cochrane | |
| 2018/0320404 | A1 | 11/2018 | Hellenbrand | |
| 2019/0003202 | A1 | 1/2019 | Abdus-Samad | |
| 2019/0024405 | A1 | 1/2019 | Gooden | |
| 2019/0078350 | A1 | 3/2019 | Boado | |
| 2019/0085589 | A1 | 3/2019 | McKinney | |
| 2019/0085590 | A1 | 3/2019 | Harry et al. | |
| 2019/0177997 | A1 | 6/2019 | Springborn | |
| 2019/0218817 | A1 | 7/2019 | Goodrich et al. | |
| 2019/0226230 | A1 | 7/2019 | Langenwalter | |

FOREIGN PATENT DOCUMENTS

| | | | | |
|---|---|---|---|---|
| CA | 2256263 | | 12/1998 | |
| CA | 2493736 | A1 | 7/2005 | |
| CA | 2460983 | C | 9/2005 | |
| CA | 2607388 | C | 11/2006 | |
| CA | 2597122 | A1 | 1/2007 | |
| CA | 2621675 | C | 8/2009 | |
| CA | 2669440 | C | 12/2010 | |
| CA | 2736301 | A1 | 10/2011 | |
| CA | 2814855 | C | 4/2012 | |
| CA | 2820331 | C | 12/2013 | |
| CA | 2851471 | C | 11/2014 | |
| CA | 2893389 | A1 | 12/2015 | |
| CA | 2914022 | A1 | 6/2016 | |
| CA | 2997630 | A1 | 3/2017 | |
| CA | 2932974 | A1 | 12/2017 | |
| CN | 108316756 | A * | 7/2018 | |
| EP | 1600582 | A2 | 11/2005 | |
| FR | 2854412 | A1 * | 11/2004 | E01F 13/022 |
| FR | 2886328 | A1 * | 12/2006 | E04H 17/165 |
| KR | 102247508 | B1 * | 5/2021 | |

* cited by examiner

PREFABRICATED MODULAR FENCING WITH ADVANTAGEOUSLY-SHAPED CONNECTORS

CROSS REFERENCE TO RELATED APPLICATIONS

This application claims the benefit of priority of U. S. Provisional Application Ser. No. 63/035,999, filed on Jun. 8, 2020, which is incorporated herein in its entirety.

TECHNOLOGICAL FIELD

The present invention relates to prefabricated modular fencing and, more particularly, to prefabricated modular fencing with advantageously-shaped connectors that interfit with one another between adjacent fence panels.

DESCRIPTION OF THE RELATED ART

Fences have been erected in many and varied styles. It is desirable in some applications for fencing to be partially prefabricated off-site, as prefabrication simplifies installation and reduces costs as a result of, for example, economies of scale. Accordingly, prefabricated fencing panels have been provided. Prefabricated fencing includes barrier sections that may be joined, for example serially, and secured to the ground so as to result in a fence run, also referred to as a "fence line" (even though the fencing need not reside in a straight linear line), that required reduced assembly labor and time on-site.

Modularity of prefabricated fencing panels is also desirable. Inasmuch as plans may be altered during installation of fencing, or additional fencing may be discovered to be desirable after insulation of an initial run, or later replacement may be desired of a section of a section of fencing damaged after installation, modularity of design allows for easy and aesthetically matching, consistent final results.

The process of erecting a fence, even by the use of prefabricated fencing panels, can be clumsy and less than ideal. For example, the prefabricated fencing panels may be laid out flat on the ground along the intended fence line, but until they are oriented vertically, the aesthetic appearance of the intended fence run cannot be fully assessed. For another example, until the prefabricated fencing panels are oriented vertically along an intended run of fence, the effectiveness of the fencing run in achieving its desired purpose cannot be fully assessed. Still further, until the prefabricated fencing panels are oriented vertically along an intended run of fence, interference with other landscape features, such as trees and bushes, cannot be fully observed, considered, and thereby accommodated. For these and for many other reasons, it is desirable when erecting a fence using prefabricated fencing panels to stand each fencing panel vertically in what is at least preliminarily thought to be its final location before deciding that, indeed, such location should be finalized by securing the fencing to the ground or, instead, deciding that further location adjustment is preferred. However, the known prefabricated fencing panels cannot be stood vertically on their own but instead each one must be laboriously, tediously propped up with rods or boards from the sides, one by one, or clamped together, or other cumbersome arrangement. It would, accordingly, be desirable for prefabricated fencing panels to be able to be interfitted preliminarily with one another in a vertical orientation with minimal or no propping, and to be able to be easily disengaged from one another and moved during installation if the location of the fencing run is decided to be changed.

The fencing products previously known do not ideally address the foregoing concerns. The present invention relates to an improvement upon the known systems and methods for prefabricated fencing panels and provides distinct advantages over the conventional systems and methods.

BRIEF SUMMARY OF THE INVENTION

In response to the discussed difficulties and problems encountered before, a new prefabricated modular fencing with advantageously-shaped connectors has been discovered.

In accordance with certain aspects of certain embodiments of the present technology, a prefabricated modular fencing is provided. The fencing includes a fence panel with a first end and an opposing second end. A first connector is provided, the first connector residing outboard the fence panel at the first end. A second connector is also provided, the second connector residing outboard the fence panel at the second end. Each of the first and second connectors has an upper side and an opposing lower side, and one of a concavity and a convexity on the upper side and the other of a concavity and a convexity on the lower side. The concavity may be sized complementary to the convexity and may have therethrough a bore, the bore defined through the concavity and convexity and sized to receive a post.

In particular embodiments, each concavity may be a smooth frustoconical. Certain configurations provide for the panel to be one or more of vinyl, steel, aluminum, wood, and chain link. In some examples, the panel includes at least a horizontal rail and plural vertical pickets. Individual forms may further include a post interfitted through the bore of the first connector and, optionally, attached at one end to a pointed stake. The panel may be rectangular with selective illustrations, but in others it may be of any desirable shape, including of irregular geometry.

In accordance with additional aspects of other embodiments of the present technology, a prefabricated modular fencing kit is provided that includes a fencing panel. The fencing panel may have a first end and an opposing second end. It may also include first and second connectors residing at the first end at a first distance apart, and third and fourth connectors residing at the second end at a second distance apart. Each of the first, second, third, and fourth connectors may have an upper side and an opposed lower side, each upper side being one of a concavity and a convexity and each lower side being the other of a concavity and a convexity. Each of the concavities may define therethrough a bore having a minimum width. A post is also provided, the post having a length greater than the first and second heights and having a maximum width that is smaller than the minimum width of the bore. Additionally and/or alternatively, in various embodiments one or more of the following aspects may also be included:

(a) the convexity of the first connector is complementary to the concavity of the third connector, and the convexity of the second connector is complementary to the concavity of the fourth connector;

(b) the convexity of the first, second, third, and fourth connectors are identical and complementary to the concavity of the first, second, third, and fourth connectors;

(c) the first and second ends terminate at a bottom, the first connector residing lower than the second connector and a third distance from the bottom, the third connector residing lower than the fourth connector and a fourth distance from the bottom, the third distance being greater than the fourth distance, and the first distance being equal to the second distance;

(d) the concavities and convexities are frustoconical;

(e) the concavities and convexities include facets;

(f) the first and second panels are one or more of vinyl, steel, aluminum, wood, and chain link;

(g) the first and second panels are one or more of wrought iron, plastics, or composites;

(h) the first and second panels have at least one horizontal rail and plural vertical pickets;

(i) a stake is included, separate from the post;

(j) a stake is included that has a post receiver, and the post includes a socket therein for receipt of the post receiver; and/or (k) a stake is included that has a socket configured for receipt therein of the post; and/or (g) a method of constructing a fence, comprising the steps of:

providing the prefabricated modular fencing kit described in Paragraph 0010;

providing a second fencing panel, the second fencing panel having:

a third end and an opposing fourth end;

fifth and sixth connectors residing at the third end at a first distance apart;

each of the fifth and sixth connectors having an upper side and an opposed lower side;

each upper side being one of a concavity and a convexity and each lower side being the other of a concavity and convexity;

each of the concavities defining therethrough a bore having the minimum width; and disposing the fencing panel of Paragraph 0010 upright at a first location;

disposing the second fencing panel upright at a second location adjacent to the first location;

maintaining the fencing panel of Paragraph 0010 and the second fencing panel in their respective upright positions by interfitting the convexity of the first connector into the concavity of the fifth connector and by interfitting the convexity of the second connector into the concavity of the sixth connector; and inserting the post through the bores of the first, second, fifth, and sixth connectors.

In accordance with yet additional aspects of other embodiments of the present technology, a prefabricated modular fencing system comprising first and second fence panels is provided. The first panel may have opposing first and second side ends, the first side end carrying a first connector and a second connector, the first and second connectors residing outboard of the first fence panel. The second fence panel may have opposing third and fourth side ends, the third side end carrying a third connector and a fourth connector residing outboard of the second fence panel. The first, second, third, and fourth connectors may have upper sides defining one of a concavity and a convexity and lower sides defining the other of a concavity and a convexity, as well as defining a bore within each convexity. The convexity of the third connector may be complementary with and reside within the concavity of the first connector, and the convexity of the fourth connector may be complementary with and reside within the concavity of the second connector. A post may be disposed through the bores of the first, second, third, and fourth connectors. Additionally and/or alternatively, in various embodiments one or more of the following aspects may also be included:

(a) the first and second fence panels include one or more of vinyl, steel, aluminum, wood, and chain link;

(b) the first and second fence panels are rectangular;

(c) the first panel is of a first shape and the second panel is of a different shape;

(d) the concavity is a negative frustoconical;

(e) a stake is included, the stake having a lower end and an upper end, the upper end carrying a post receiver with an aperture, the aperture configured to receive within it the post; and/or (f) a stake having a lower end and an upper end is included, the upper end carrying a post receiver configured to insert into the post; and/or (g) a method of constructing a fence, comprising the steps of:

providing a first and second fencing panel, each panel having opposed side ends, upper and lower connectors residing outboard at each side end, and each of the connectors having an upper side and an opposing lower side, with one of a concavity and a convexity on the upper side and the other of a concavity and a convexity on the lower side, and defining a bore through each concavity;

disposing the first fencing panel upright at a first tentative final location;

disposing the second fencing panel upright at a second tentative final location adjacent to the first tentative final location;

maintaining the first fencing panel and the second fencing panel in their respective upright positions by interfitting the convexity and concavity of adjacent connectors;

optionally adjusting the respective locations of one or both of the first fencing panel and the second fencing panel to respective definite final locations; and inserting the post through the bores of the interfitted connectors.

In certain applications, this method may be performed by undertaking the listed steps in the order disclosed above; in other applications, the method may be performed by undertaking the listed steps in a different order.

The foregoing description sets forth broadly certain features of the present invention so that the detailed description herein below may be better understood, and so that the present contributions to the art from this invention may be better appreciated.

Other advantages of the present invention will become apparent from the following descriptions, taken in connection with the accompanying drawings, wherein, by way of illustration and example, embodiments of the present invention are disclosed.

BRIEF DESCRIPTION OF THE SEVERAL VIEWS OF THE DRAWINGS

The details of the present invention, both as to its structure and operation, can be understood in reference to the detailed description below in combination with the drawings, in which.

Figure 1:
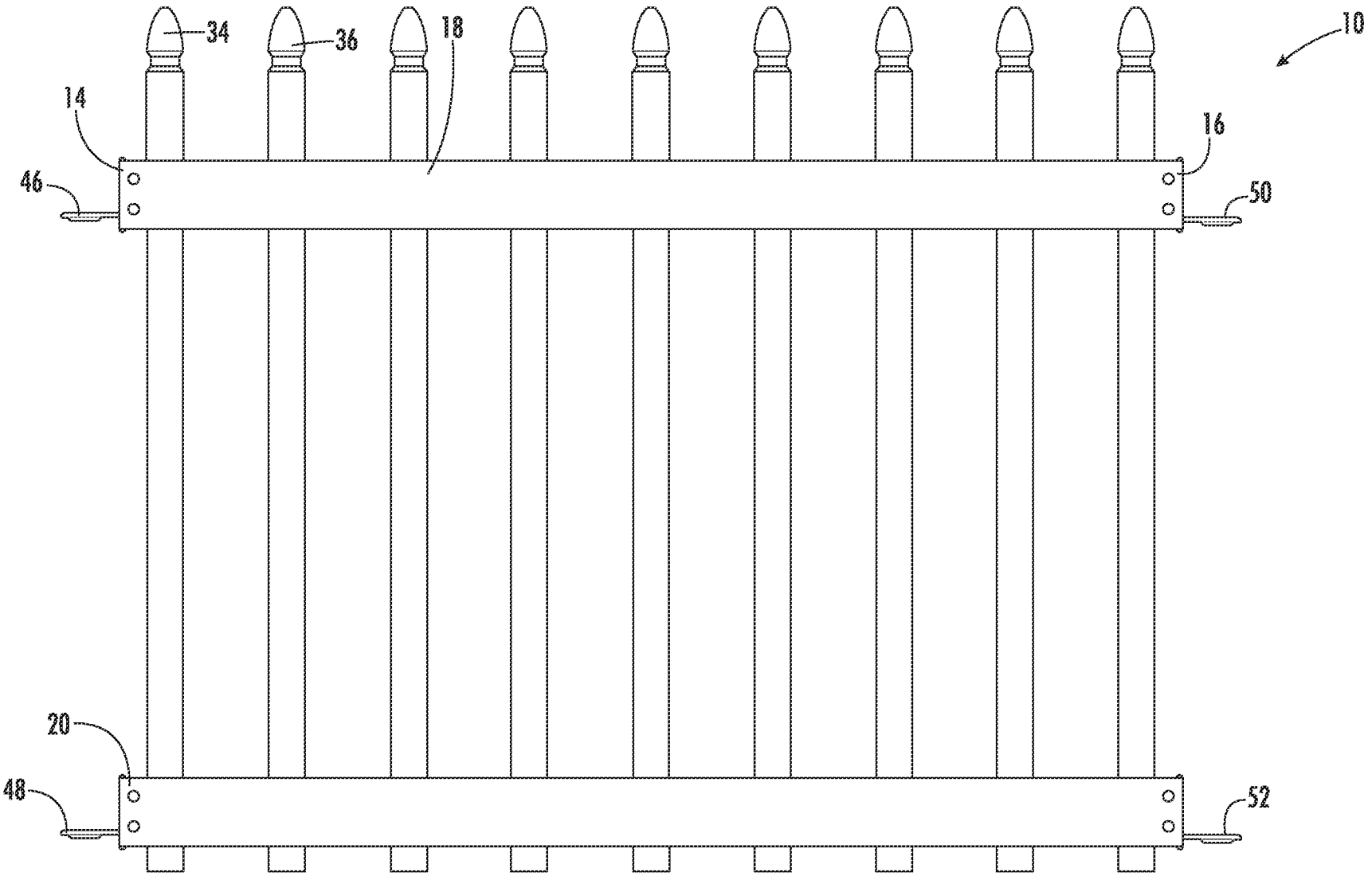
FIG. 1 is an elevation view of prefabricated modular fencing with advantageously-shaped connectors in accordance with an embodiment of the present invention.

It should be noted that the drawings discussed above and below are not to scale in all instances, but may have exaggerated dimensions in some respects to illustrate one or more of the principles of the invention.

DETAILED DESCRIPTION OF THE INVENTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. The embodiments of the present invention described below are not exhaustive nor do they limit the invention to the precise forms disclosed. Rather, the described embodiments are chosen so that others skilled in the art to which this invention pertains may appreciate and understand the principles and practice of the present invention.

Selected combinations of aspects of the disclosed technology correspond to a plurality of different embodiments of the present invention. It should be noted that each of the exemplary embodiments presented and discussed herein should not insinuate limitations of the present subject matter. Features or steps illustrated or described as part of one embodiment may be used in combination with aspects of another embodiment to yield yet further embodiments. Additionally, certain features may be interchanged with similar devices or features not expressly mentioned which perform the same or similar function.

It is to be understood that the phraseology and terminology used herein is for the purpose of description and should not be regarded as limiting.

The use of "including," "comprising," or "having" and variations thereof herein is meant to encompass the items listed thereafter and equivalents thereof as well as additional items. The term "prefabricated" means that two or more components have been joined, attached, or assembled beforehand. The term "concavity" refers to a hollow or projection inward. The term "convexity" refers to a projection outward. The term "complementary" means "can fit together"; thus, a concavity may be "complementary" to a convexity if the convexity can fit together in the concavity because the shape of the concavity generally or sufficiently matches the shape of the convexity. The term "horizontal" refers to an orientation generally parallel to the horizon, and the term "vertical" refers to an orientation perpendicular to horizontal and generally perpendicular to the horizon. Unless specified or limited otherwise, the term "carrying" and variations thereof is used broadly and encompasses direct and indirect connections. As used herein, the term "upper" and like terms refer to a direction relatively further from the ground to which the fencing is, or is to be, secured. The term "lower," "below," and like terms refer to the direction opposite "upper," a direction relatively closer to the ground to which the fencing is, or is to be, secured.

Examples of prefabricated fencing are included in the disclosures of U.S. Pat. Nos. 9,995,059; 9,689,177; 9,027,909; 8,931,761; 8,833,737; 8,152,141; 7,677,534; and 7,676,926, and in U. S. Published Apps. 2019/0226230; 2010/0133492; and 2007/0267616, the full disclosures of which are incorporated herein by reference.

A prefabricated modular fencing with advantageously-shaped connectors is provided. The following aspects may be referenced:

first panel 10
second panel 12
first end 14
second end 16
first rail 18
second rail 20
third rail 22
upper surface 24
lower surface 26
first aperture 28
second aperture 30
chain link segment 32
first picket 34
second picket 36
first prominence 38
second prominence 40
third prominence 42
fourth prominence 44
first connector 46
second connector 48
third connector 50
fourth connector 52
bore 54
upper side 56
concavity 57
lower side 58
convexity 59
facet 60
attachment profile 62
first gate ring 64
second gate ring 66
third gate ring 68
fourth gate ring 70
bushing 71
gate latch 72
post 74
stake 76
finial 78
first stake blade 80
second stake blade 82
third stake blade 84
fourth stake blade 86
stake receiver 88
projection 89
point 90
first socket (in post) 92
second socket (in stake) 94
first gate panel 96
second gate panel 98

The prefabricated modular fencing may include a fencing panel such as first panel 10, connectors such as first connector 46 and second connector 48, a post 74 and a stake 76, and one or more gate panels such as a first gate panel 96 and second gate panel 98.

First panel 10 may be of a rectangular shape in some embodiments. However, in other embodiments first panel 10 may be of other configurations. Along a particular fencing line, a first panel 10 may be of a particular configuration such as, for example, rectangular and an adjacent, second panel 12 may be of the same particular configuration or second panel 12 may be of a different configuration such as, for example, trapezoidal, as desired by the user.

The fence panels, such as first panel 10, may be configured of vinyl, steel, aluminum, wood, or chain link, or any combination of those or other materials.

First panel 10 may be understood to have a first end 14 and an opposite second end 16, first end 14 and second end 16 residing at opposite lateral ends along the length of first panel 10.

In some configurations, first panel 10 may include a first rail 18, a second rail 20, and in certain examples also a third rail 22, first rail 18, second rail 20, and third rail 22 disposed generally horizontally and generally parallel to the length of first panel 10. Likewise, in some embodiments, fencing panel 10 may include one or more pickets, for example first picket 34 and second picket 36, extending generally vertically between first rail 18 and second rail 20.

One or more connectors, such as first connector 46 and second connector 48, may be included with this prefabricated modular fencing, carried by a fence panel such as first panel 10. Each connector, such as first connector 46 and second connector 48, may be understood to have an upper side 56 and an opposing lower side 58. Each connector, such as first connector 46 and second connector 48, may have one of a concavity 57 and a convexity 59 on the upper side and the other of a concavity 57 and a convexity 59 on the lower side, and define therethrough a bore 54. The bore 54 may be sized to receive therethrough a post, such as post 74. In some embodiments, the concavities and convexities may be frustoconical and, in certain applications, smooth frustoconicals. In other embodiments the concavities and convexities may include one or more facets, such as a facet 60; use of such facets may facilitate positioning of adjacent fencing panels, such as first panel 10 and second panel 12, at advantageous predetermined angular relationships to one another by alignment of a facet, such as facet 60, on a convexity 59 with a facet in a concavity 57 into which the convexity 59 is interfitted.

Multiple such connectors, such as first connector 46*a*, second connector 48*a*, third connector 50*a*, and fourth connector 52*a*, may be carried upon and reside outboard of first end 14 and second end 16, two or more to each side. (The use of a suffix "a" with a component designation signifies that the component exists as to a first panel 10, and the use of a suffix "b" with a component designation signifies that the component exists as to a second panel 12. Thus, for example, "first connector 46*a*" signifies that the first connector 46 exists as to a first panel 10, while, for example, "first connector 46*b*" signifies that the first connector 46 exists as to a second panel 12.)

In some applications, multiple panels, including panels 10 and 12, will be interfitted together to form a completed fence line. In those applications, first panel 10 may carry first connector 46*a* and second connector 48*a* upon first end 14*a*, first connector 46*a* and second connector 48*a* being expected and designed to interfit with third connector 50*b* and fourth connector 52*b* of a second panel 12. First connector 46*a* and second connector 48*a* would have concavities 57 facing in a first direction, and third connector 50*b* and fourth connector 52*b* of second panel 12 would have complementary convexities 59 facing in the same first direction. Moreover, first connector 46*a* and second connector 48*a* would be dimensioned at such a first distance from the top and bottom of first panel 10, and third connector 50*b* and fourth connector 52*b* would dimensioned at such a second distance from the top and bottom of second panel 12 that, when first connector 46*a* and second connector 48*a* are interfitted with third connector 50*b* and fourth connector 52*b*, respectively, first panel 10 and second panel 12 will be aligned and even, once first panel 10 and second panel 12 were joined as described in this paragraph. In this example, it is only recognized that the concavity 57 of first connector 46*a* be complementary to the convexity 59 of third connector 50*b*, and that the concavity 57 of second connector 48*a* be complementary to the convexity 59 of fourth connector 52*b*; the concavity 57 of first connector 46*a* may be different than the concavity of second connector 48*a*. In other applications, it may desirable that the concavities of first connector 46, second connector 48, third connector 50, and fourth connector 52 be identical, and that the convexities of first connector 46, second connector 48, third connector 50, and fourth connector 52 be identical.

For another example, a first panel 10 may carry first connector 46*a* and second connector 48*a* upon first end 14*a*, and third connector 50*a* and fourth connector 52*a* on second end 16*a*. In this example, first connector 46*a* and second connector 48*a* may reside a first distance apart, and third connector 50*a* and fourth connector 52*a* may reside a second distance apart. In particular embodiments, the first distance may equal the second distance, but need not in all embodiments. Still further, second connector 48*a* may reside closer to the bottom of first panel 10 than does fourth connector 52*a*. Similarly, a second panel 12 may carry first connector 46*b* and second connector 48*b* upon first end 14*b*, and third connector 50*b* and fourth connector 52*b* on second end 16*b*. In this example, first connector 46*b* and second connector 48*b* may reside the first distance apart, and third connector 50*b* and fourth connector 52*b* may reside the second distance apart. Still further, second connector 48*b* may reside closer to the bottom of second panel 12 than does fourth connector 52*b*. So configured, the convexity 59*a* of first connector 46*a* of first panel 10 would be positioned to be disposed in the concavity 57*b* of third connector 50*b* of second panel 12, and the convexity 59*a* of second connector 48*a* of first panel 10 would be positioned to be disposed in the concavity 57*b* of fourth connector 52*b* of second panel 12, yet if the relative spacings of the connectors 46*a*, 50*b*, 48*a* and 52*b* as to the bottoms and/or tops of, respectively, first panel 10 and second panel 12 were predetermined accordingly, first panel 10 and second panel 12 would be aligned and even once first panel 10 and second panel 12 were joined as described in this paragraph.

The preceding examples depict embodiments in which two connectors reside on each of first end 14 and second end 16, but the present technology is not limited to such a count and these examples are offered for illustration only. Other examples may include a single connector on each of first end 14 and second end 16, while still other examples may include three or more connectors on each of first end 14 and second end 16, as circumstances may suggest to be desirable and/or advantageous.

The connectors, such as first connector 46, may be fabricated from vinyl, steel, aluminum, plastic, composite, or other material. They may be carried by a panel, such as first panel 10, by weldment, adhesive, press fit engagement, mechanical fasteners such as screws and/or bolts, or other methods of connection.

A post and stake, such as post 74 and stake 76, are also included in the present invention. Post 74 is a linear member, fabricated of vinyl, steel, aluminum, wood, wrought iron, plastics, composites, or any combination of those or other materials. Post 74 is sized such that its greatest width is less than the minimum width of any bore 54 through a connector, such as first connector 46. So configured, post 74 may be interfitted through a bore 54 of a connector, such as first connector 46.

Post 74 may be inserted at its lower end into the ground upon which the present fencing is installed. Optionally, or alternatively, Post 74 may be attached at one end to stake 76. Stake 76 may be a separate member from post 74. Stake 76 may include a second socket 94 configured for receipt therein of the lower end of post 74. Alternatively, stake 76 may include a projection 89, projection 89 extending into first socket 92 of post 74 when stake 76 and post 74 are joined.

Post 74 may have a length greater than the separation between any two connectors through which it is to be disposed, such as first connector 46 and second connector 48, carried by a single end, such as end 14, of a fence panel, such as first panel 10.

Two connectors, such as first connector 46 and second connector 48, carried by a single end, such as first end 14, of a fence panel, such as first panel 10, may be interfitted respectively with two other connectors, such as third connector 50 and fourth connector 52 carried by a single end, such as second end 16, of another fence panel, such as second panel 12. The first panel 10 may be disposed upright at a first tentative final location and the second panel 20 may be disposed upright at a second tentative final location. The first panel 10 and the second panel 12 may be maintained in upright positions because of the interfitting of the convexity 59 or the concavity 57 of connector 46 with its complement concavity 57 or convexity 59 of connector 50, and interfitting either the convexity 59 or the concavity 57 of connector 48 with its complement concavity 57 or convexity 59 of connector 52, and rotating, either slightly or more than slightly as circumstances may suggest, first panel 10 relative to second panel 12 about the axis formed by the bores 54 of first connector 46, second connector 48, third connector 50, and fourth connector 52, to provide an angle C between first panel 10 and second panel 12 that is not 180°. Angle C may be understood as an angle measurement in a plane generally parallel to the ground upon which first panel 10 and second panel 12 are disposed; thus, for example, if first panel 10 and second panel 12 are both planar and their connectors have been interfitted as herein described, angle C is the angle between such two planes. So arranged, minimal or no support or bracing to the side(s) of either first panel 10 or second panel 12 would be needed to maintain first panel 10 and second panel 20 in their respective tentative final locations. If the first and second tentative final locations are to be changed, either or both locations may be adjusted to respective definite final locations, with minimal or no support or bracing to the side(s) of either first panel 10 or second panel 12. When the ultimate desired locations of first panel 10 and second panel 12 are decided, stake 76 may be driven into the ground after having been inserted through the bores 54 of interfitted connectors 46 with 50 and 48 with 52, and optionally attached to stake 76. Thus, two fence panels, such as first panel 10 and second panel 12, may be joined to construct a fence run. It will be recognized, as well, that, so configured, first panel 10 may be rotated relative to second panel 12 about post 74.

Gate panels, such as one or more of first gate panel 96 and second gate panel 98, may also be included in the subject invention. Gate panels 96, 98 may be of a rectangular shape in some embodiments. However, in other embodiments they may be of other configurations, either to follow the appearance and configuration of first fence panel 10 and second fence panel 12 or, if desired, to contrast with the appearance and configuration of first fence panel 10 and second fence panel 12.

Gate panels 96, 98 may be configured of vinyl, steel, aluminum, wood, or chain link, or any combination of those or other materials.

First gate panel 96 may be understood to have opposite ends. To join with a fence panel 10, gate panel 96 may carry first gate ring 64 and second gate ring 66 upon a single end side, to receive therethrough a post 74 that is also received through connectors 50 and 52 carried by, for example, the second end 16 of fence panel 10. So configured, gate panel 96 may be rotated relative to first panel 10 about post 74.

Figure 4:
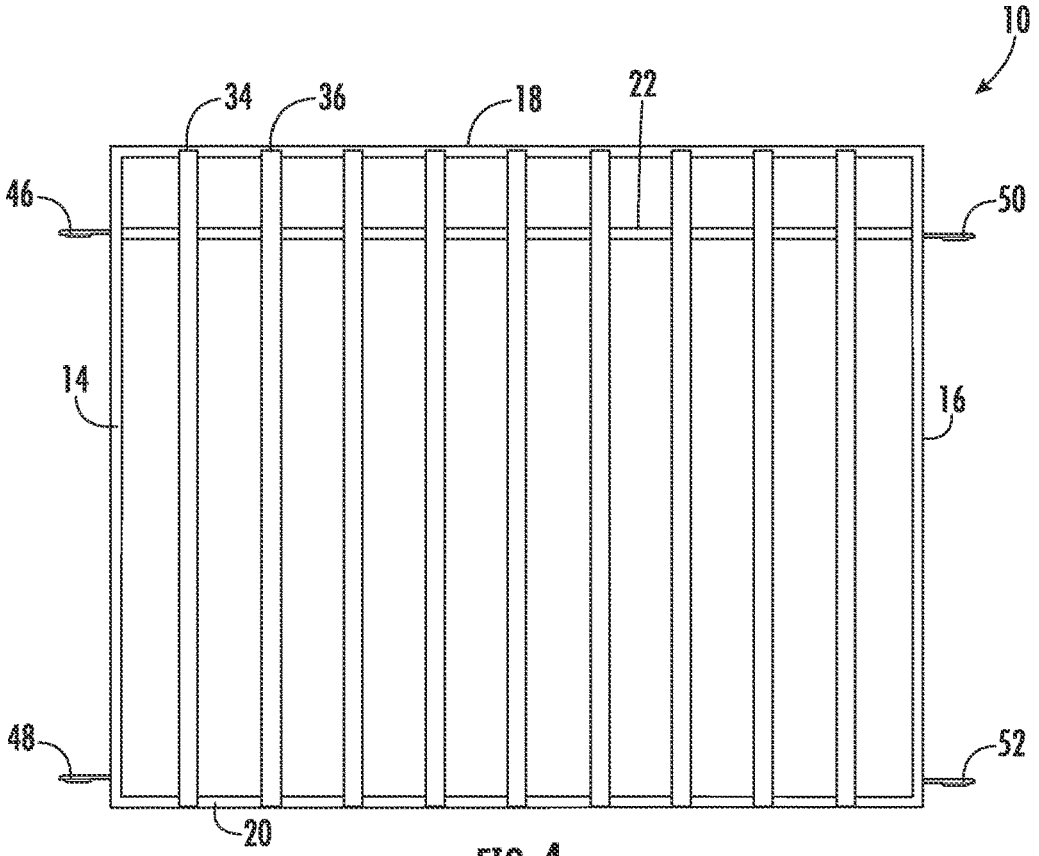
FIG. 4 is an elevation view of prefabricated modular fencing with advantageously-shaped connectors in accordance with an embodiment of the present invention.
Figure 6:
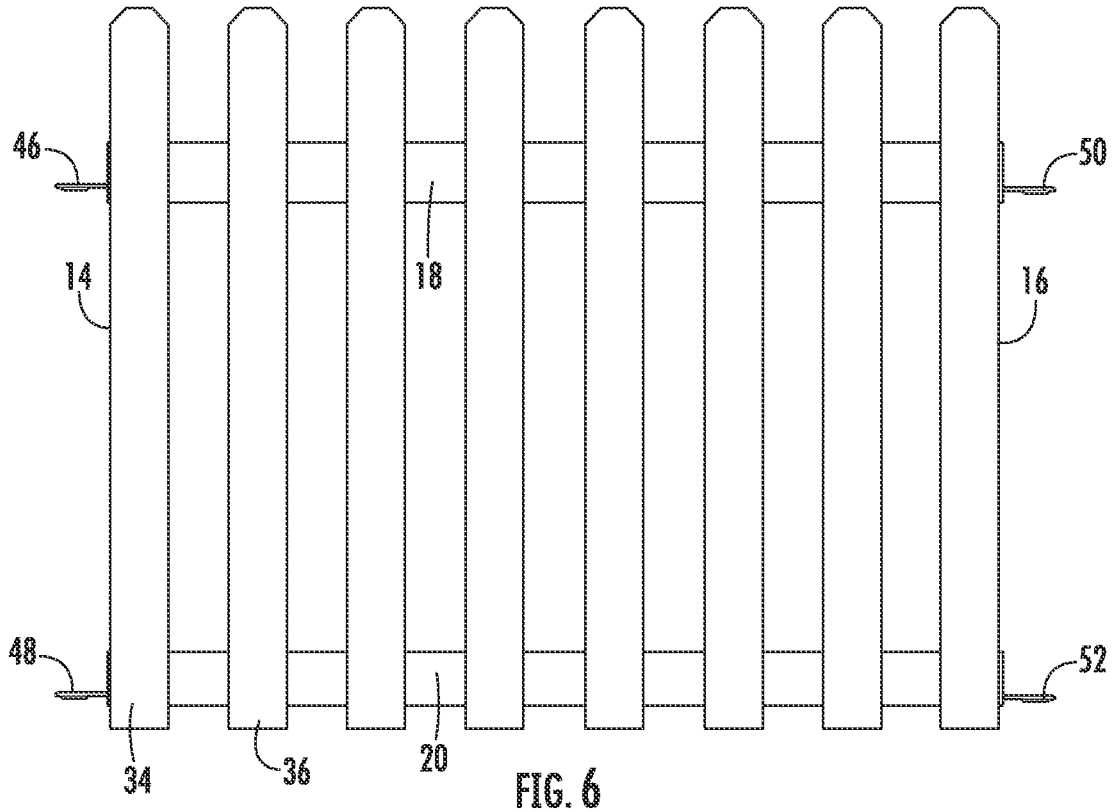
FIG. 6 is an elevation view of prefabricated modular fencing with advantageously-shaped connectors in accordance with an embodiment of the present invention.
Figure 9:
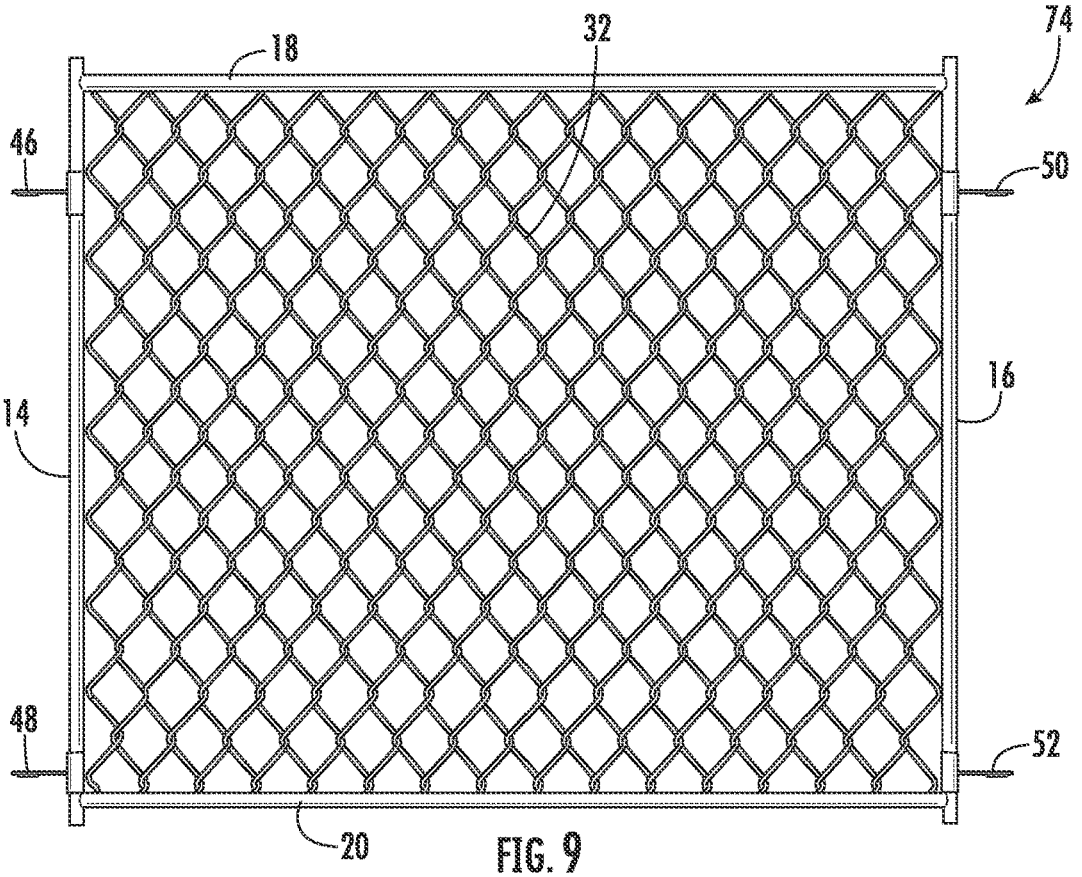
FIG. 9 is an elevation view of prefabricated modular fencing with advantageously-shaped connectors in accordance with an embodiment of the present invention.

The details of the present invention may be further understood with reference to the figures. FIGS. 1, 4, 6, and 9 illustrative different embodiments of a first panel 10. FIG. 1 illustrates a first panel 10 comprising vinyl, polyvinyl chloride, plastic, and/or other synthetic polymer. FIG. 4 illustrates a first panel 10 comprising steel, aluminum, or other metal. FIG. 6 illustrates a first panel 10 comprising wood. And FIG. 9 illustrates a first panel 10 that includes chain link segment 32.

As illustrated in FIGS. 1, 4, 6, and 9, first end 14 is opposite second end 16 of first panel 10. First rail 18, second rail 20, and, in some embodiments, third rail 22 extend generally horizontally along the length of first panel 10. In the embodiments of FIGS. 1, 4, and 6, for examples, first picket 34 and second picket 36 extend generally vertically between first rail 18 and second rail 20. First connector 46 and second connector 48 are carried outboard of first end 14, and third connector 50 and fourth connector 52 are carried outboard of second end 16.

In the embodiment illustrated in FIG. 9, no pickets are included, but instead a chain link segment 32 resides between first end 14 and second end 16 and between first rail 18 and second rail 20.

The embodiments illustrated in FIGS. 1, 4, 6, and 9 are only examples of the present invention. Combinations of the components and/or of the configurations illustrated in FIGS. 1, 4, 6, and 9 may be practiced according to the present invention. For an example, the components of steel and/or aluminum illustrated in the embodiment of FIG. 4 may be arranged and shaped as the rails and pickets of the embodiment illustrated in FIG. 1, and vice versa.

Figure 5:
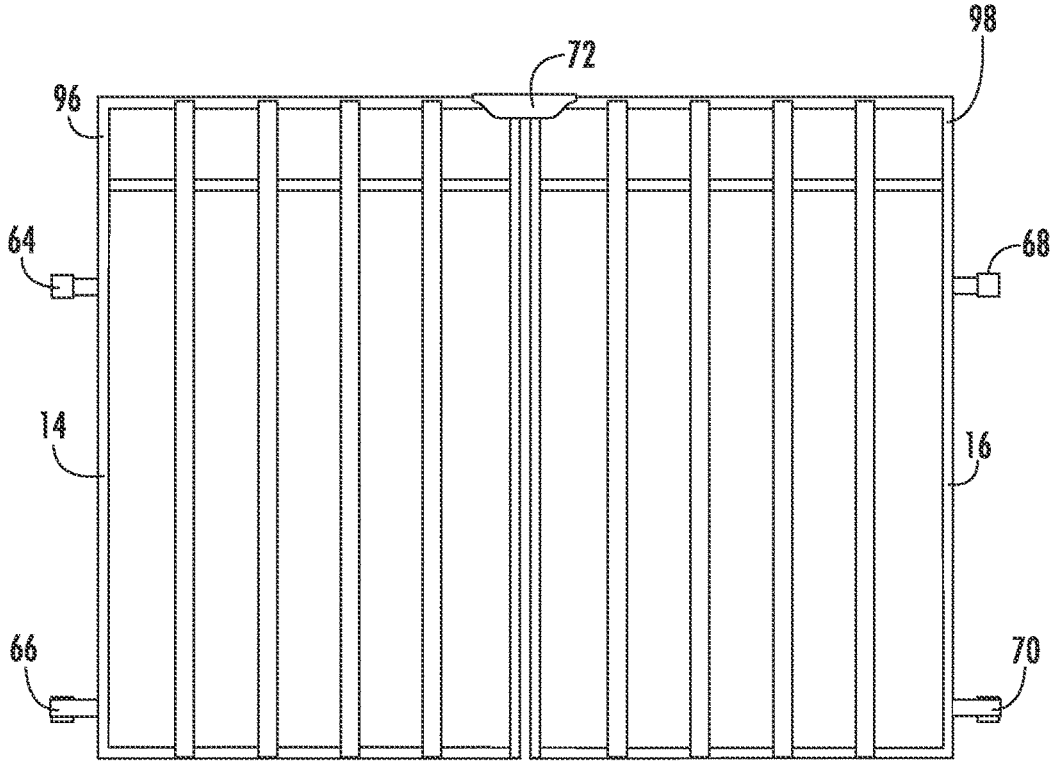
FIG. 5 is an elevation view of prefabricated modular fencing with advantageously-shaped connectors in accordance with an embodiment of the present invention.
Figure 7:
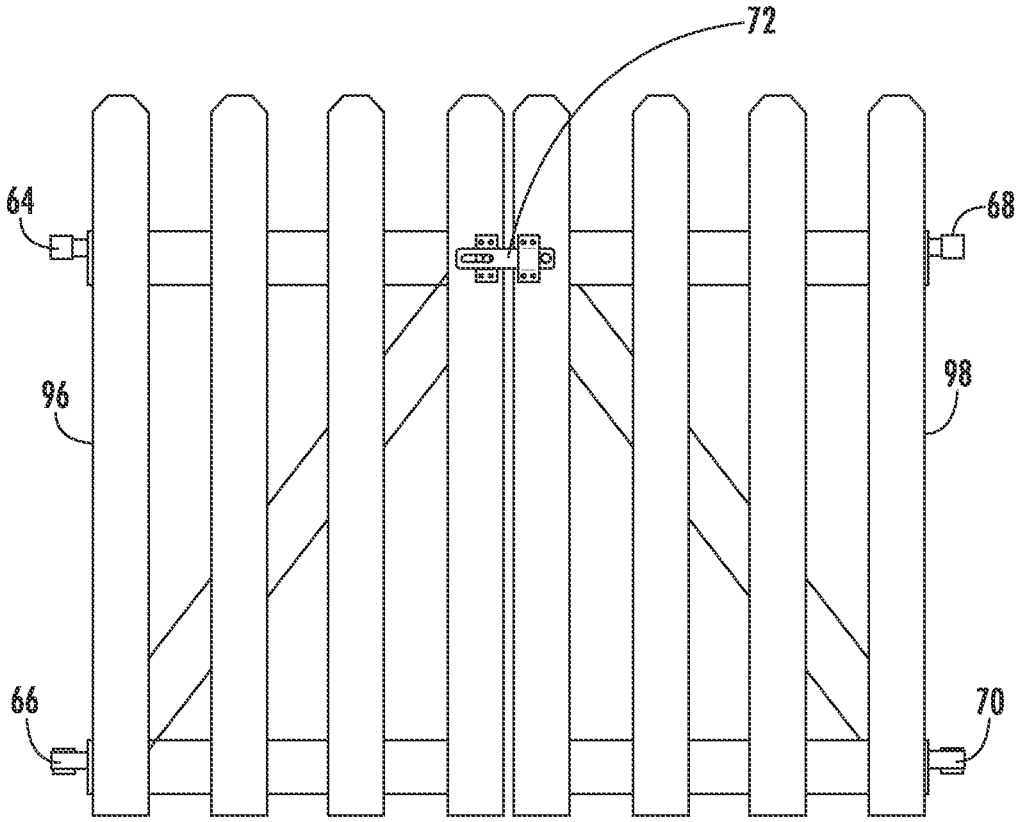
FIG. 7 is an elevation view of prefabricated modular fencing with advantageously-shaped connectors in accordance with an embodiment of the present invention.
Figure 10:
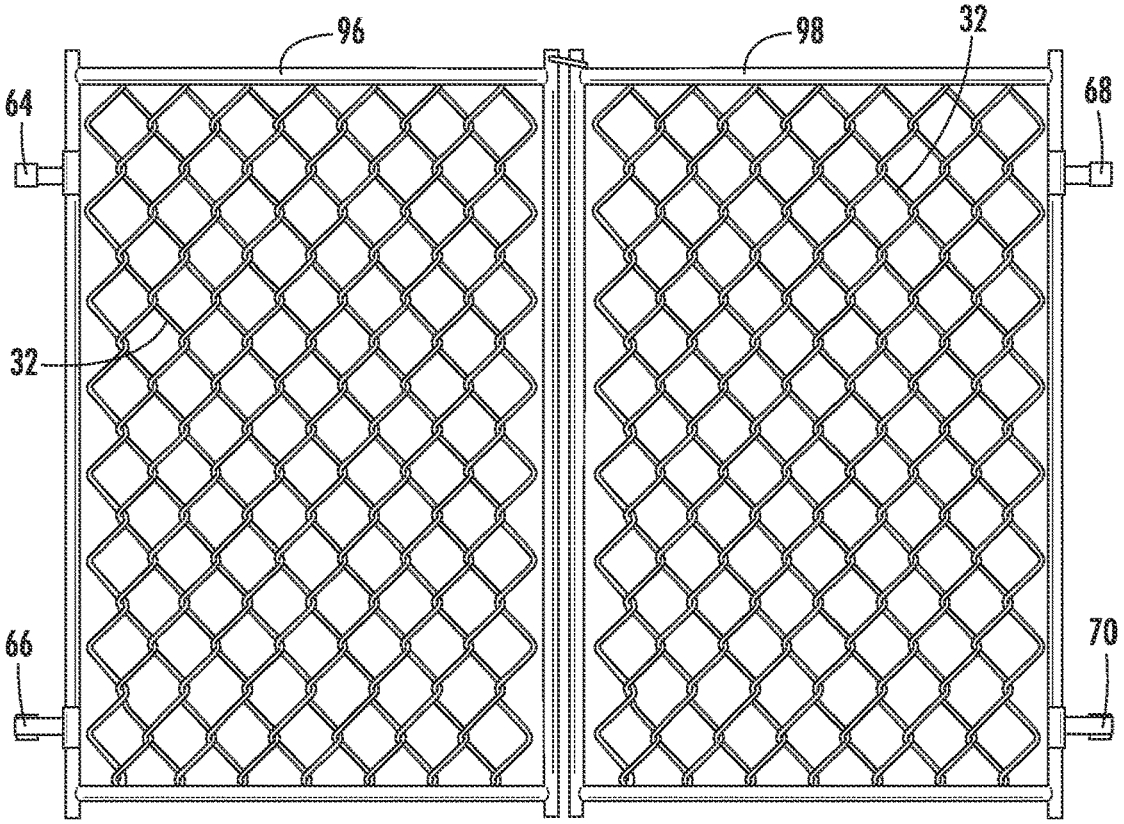
FIG. 10 is an elevation view of prefabricated modular fencing with advantageously-shaped connectors in accordance with an embodiment of the present invention.

FIGS. 5, 7, and 10 illustrate embodiments of gate panels. In some applications, only a single gate panel, for example first gate panel 96, may be used. In other embodiments, two gate panels together, for example first gate panel 96 and second gate panel 98, may be used. First gate panel 96 may carry first gate ring 64 and second gate ring 66 upon a single end side, to receive therethrough a post 74 that is also received through the adjoining third connector 50 and fourth connector 52 carried by second end 16 of a first fence panel 10. So configured, gate panel 96 may be rotated relative to first panel 10 about post 74. If a second gate panel 98 is also used, it may carry third gate ring 68 and fourth gate ring 70 upon a single end side, to receive therethrough a post 74 that is also received through the adjoining first connector 46 and second connector 48 carried by first end 14 of a second fence panel 12. So configured, gate panel 98 may be rotated relative to second panel 12 about post 74.

The embodiments illustrated in FIGS. 5 and 7 also depict use of a gate latch 72 between first gate panel 96 and second gate panel 98. Gate latch 72 may secure first gate panel 96 and second gate panel 98 closed together. In other applications, in which only a single first gate panel 96 is used without a second gate panel 98 (not shown), a gate latch 72 may likewise be used to secure the first gate panel 96 closed either to a first panel 10 or to a second panel 12.

Figure 11A:
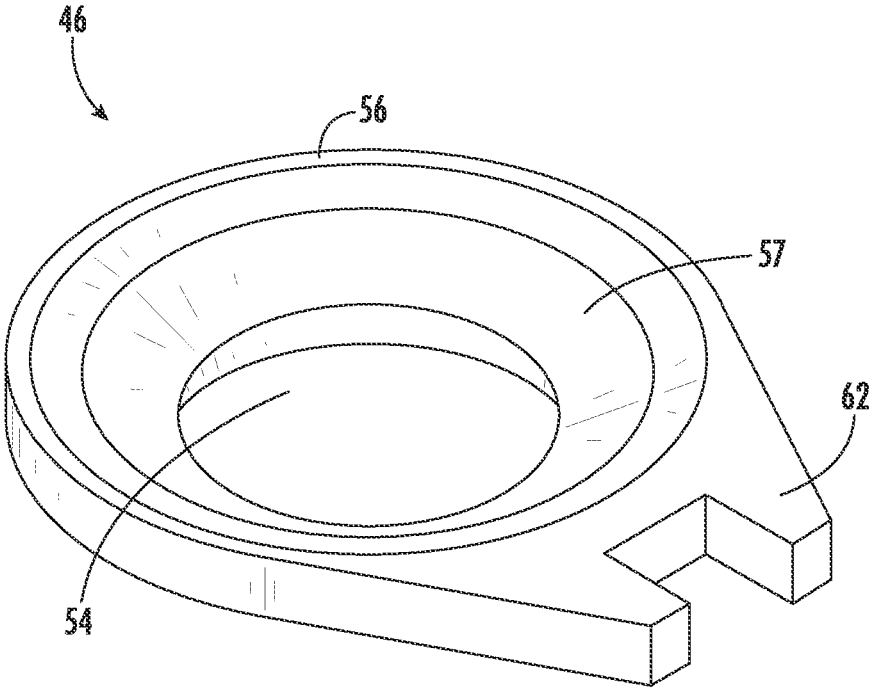
FIG. 11A is a perspective view of an advantageously-shaped connector in accordance with an embodiment of the present invention.
Figure 11B:
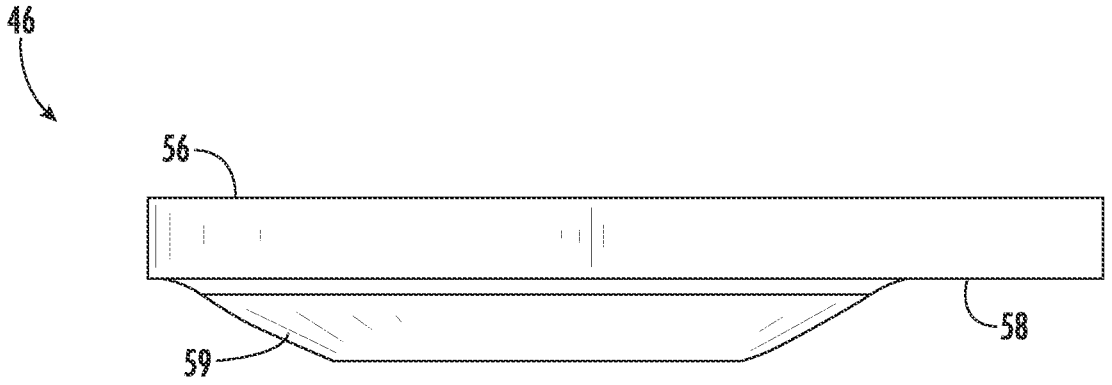
FIG. 11B is a right side elevation view of the advantageously-shaped connector of FIG. 11A, in accordance with an embodiment of the present invention.
Figure 12A:
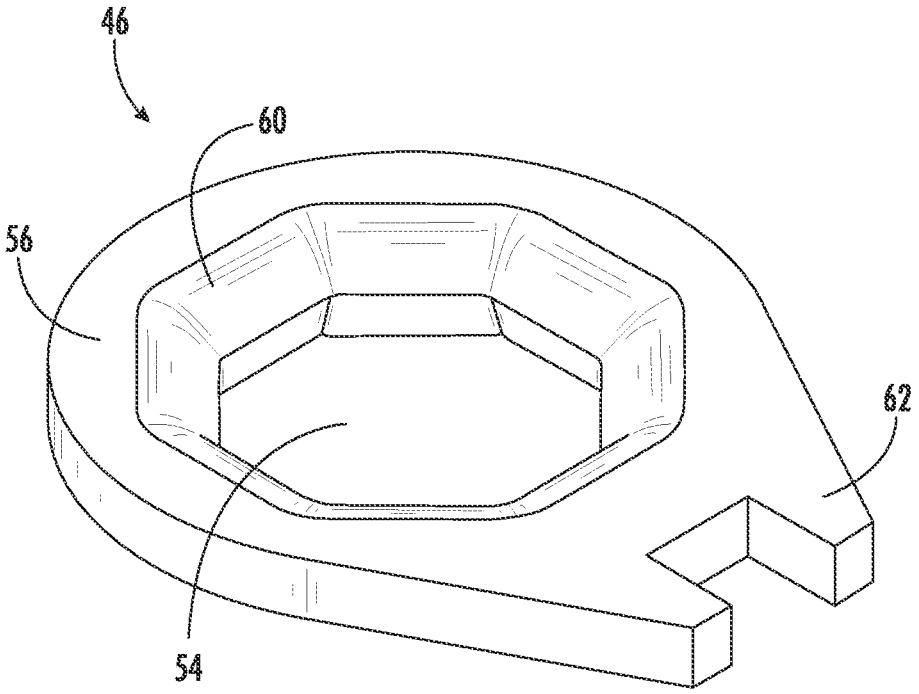
FIG. 12A is a perspective view of an advantageously-shaped connector in accordance with an embodiment of the present invention.

FIGS. 11A, 11B, 12A, 12B, 13, 14, 15, 16, and 17 illustrate embodiments of first connector 46 and third connector 50. Upper side 56 is illustrated in FIGS. 11A and 12A; lower side 58 (not shown) is opposite upper side 56. Attachment profile 62 is illustrative only, depicting a profile for attachment of first connector 46 to and end of a fence panel, such as first end 14 of a first panel 10; other shapes of attachment profile 62 may be practiced, as required for attachment of a connector to a fence panel.

FIGS. 11A and 11B illustrate a smooth frustoconical concavity 57 (FIG. 11A) within first connector 46 surrounding bore 54, as well as a smooth frustoconical convexity 59 (FIG. 11B) projecting below first connector 46. It will be observed from the illustrations in FIGS. 11A and 11B that the shape of the smooth frustoconical concavity 57 on the upper side 56 of first connector 46 is complementary to the shape of the smooth frustoconical convexity 59 on the lower side 58 of first connector 46—convexity 59 can fit together with concavity 57 of two interfitted connectors because the shape of the concavity 57 generally or sufficiently matches the shape of the convexity 59.

Figure 12B:
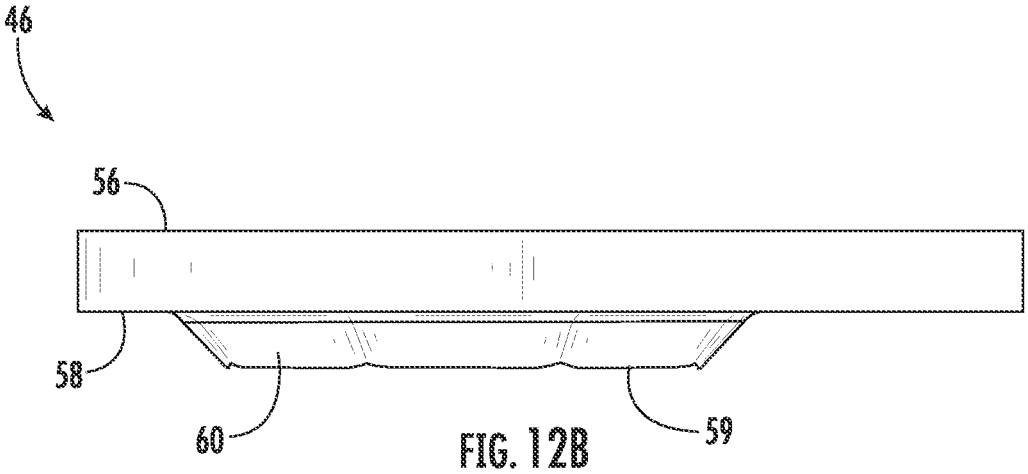
FIG. 12B is a right side elevation view of the advantageously-shaped connector of FIG. 12A, in accordance with an embodiment of the present invention.

FIGS. 12A and 12B illustrate a frustoconical concavity 57 (FIG. 12A) with plural facets 60 within the concavity 57 of first connector 46 surrounding bore 54, as well as a convexity 59 (FIG. 12B) projecting below first connector 46 that also includes plural facets 60 upon the convexity 59. It will be observed from the illustrations in FIGS. 12A and 12B that the shape of the faceted concavity 57 on the upper side 56 of first connector 46 is complementary to the shape of the faceted convexity 59 on the lower side 58 of first connector 46—a convexity 59 of a first connector, such as first connector 46, can fit together with a concavity 57 of a second connector, such as third connector 50, because the shape of the concavity 57 generally or sufficiently matches the shape of the convexity 59.

Figure 13:
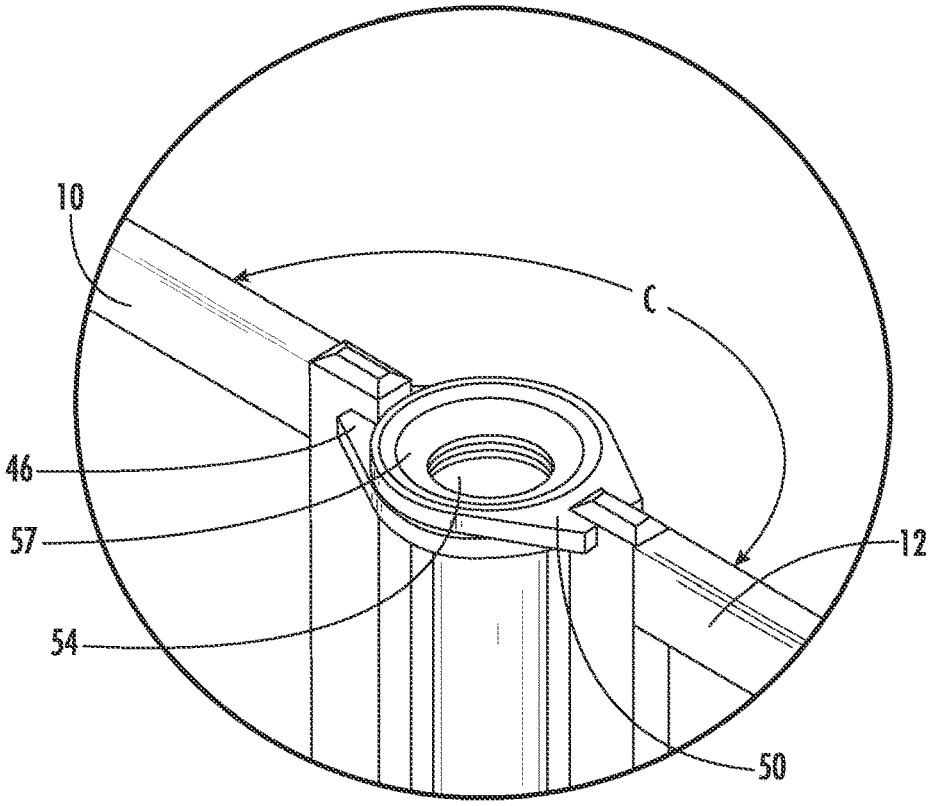
FIG. 13 is an enlarged perspective view of prefabricated modular fencing with advantageously-shaped connectors in accordance with an embodiment of the present invention.

FIG. 13 illustrates assembly of a fence with first panel 10 and second panel 12. First connector 46 is carried by first panel 10, and third connector 50 is carried by second panel 12. First connector 46 and third connector 50, which in this illustration have smooth frustoconical concavities 57 and convexities 59 as illustrated in FIGS. 11A and 11B, have been interfitted together. The first panel 10 has been disposed upright at a first tentative final location. The second panel 20 has been disposed upright at a second tentative final location. The first panel 10 and the second panel 12 maintain their respective upright tentative final positions by first panel 10 having been rotated relative to second panel 12 to provide an angle C between first panel 10 and second panel 12 that is not 180°—that is, first panel 10 and second panel 12 do not reside in a straight line—first panel 10 and second panel 12 thereby form between the a shallow V-shape to maintain their respective upright tentative final positions.

Figure 14:
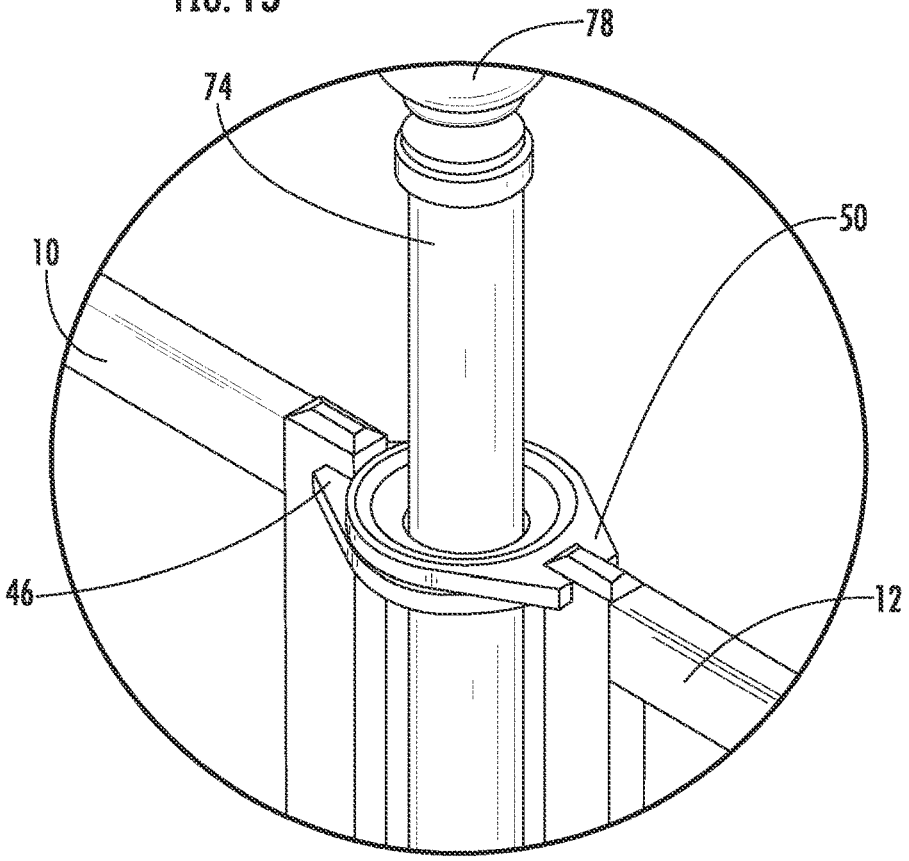
FIG. 14 is an enlarged perspective view of prefabricated modular fencing with advantageously-shaped connectors in accordance with an embodiment of the present invention.
Figure 15:
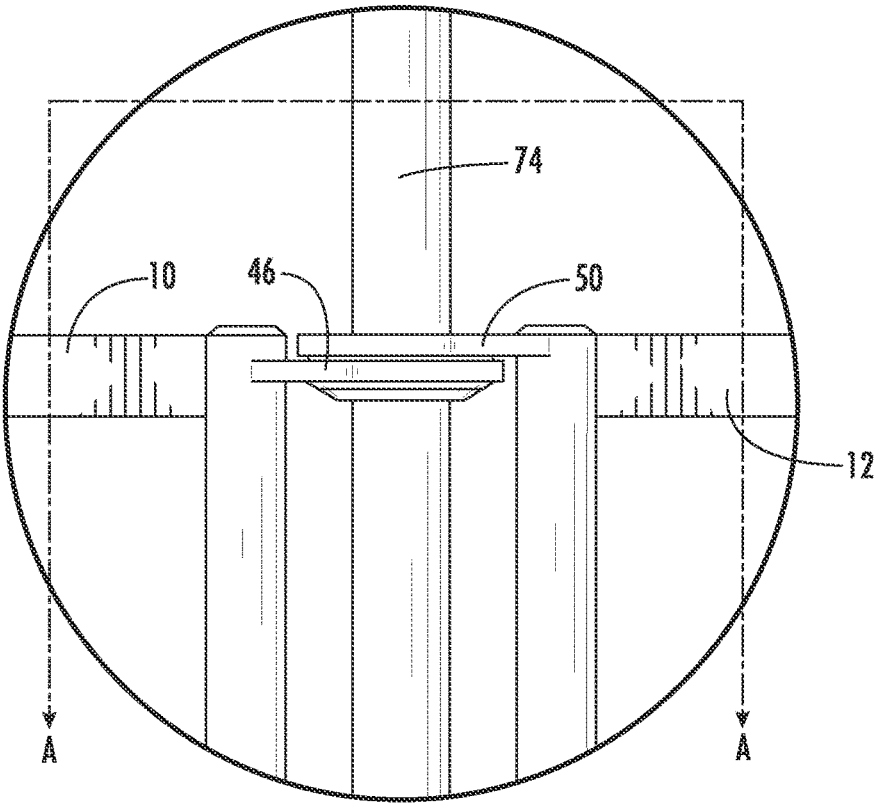
FIG. 15 is an enlarged elevation view of prefabricated modular fencing with advantageously-shaped connectors in accordance with an embodiment of the present invention.
Figure 16:
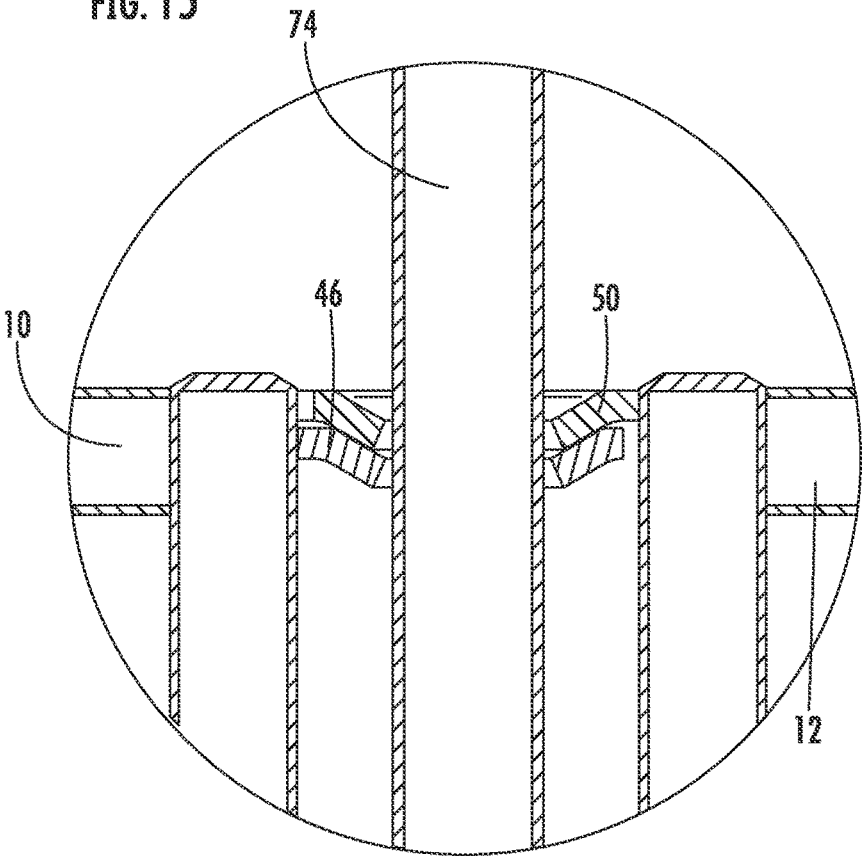
FIG. 16 is an enlarged cross-sectional view, taken at A:A in FIG. 15, of prefabricated modular fencing with advantageously-shaped connectors in accordance with an embodiment of the present invention.

FIGS. 14, 15, and 16 illustrate the result of the operation illustrated in FIG. 13, with the convexity 59 of third connector 50 interfitted into the concavity 57 of first connector 46. In FIG. 14, a post 74 has been inserted through bore 54. Post 74 has also been fitted with a finial 78. Post 74 may then be driven into the ground, either itself or with a stake 76 fitted to the bottom of post 74. It will be further observed in FIG. 14 that first connector 46 and third connector 50 have been affixed at such distances from the top of first panel 10 and second panel 12, respectively, that first panel 10 and second panel 12 will be aligned and even once first panel 10 and second panel 12 have been joined—the topmost aspects of each first panel 10 and second panel 12 lie along a single straight line. It will be still further observed in FIGS. 15 and 16 that the shape of the convexity 59 on the lower side 58 of third connector 50 is complementary to the shape of the concavity 57 on the upper side 56 of first connector 46—convexity 59 of third connector 50 can fit together with concavity 57 of first connector 46 because the shape of the concavity 57 generally or sufficiently matches the shape of the convexity 59.

Figure 17:
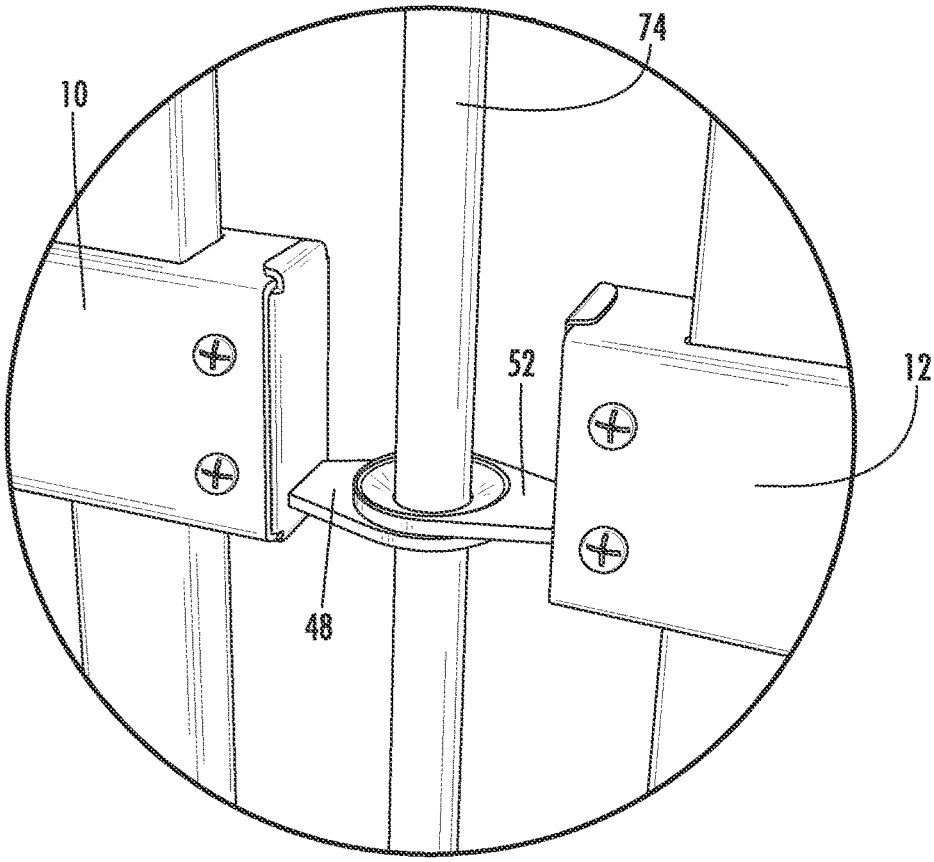
FIG. 17 is an enlarged perspective view of prefabricated modular fencing with advantageously-shaped connectors in accordance with an embodiment of the present invention.

FIG. 17 illustrates the result of the assembly of FIG. 13, but as to second connector 48 receiving into its concavity 57 the convexity 59 of fourth connector 52.

Figure 18:
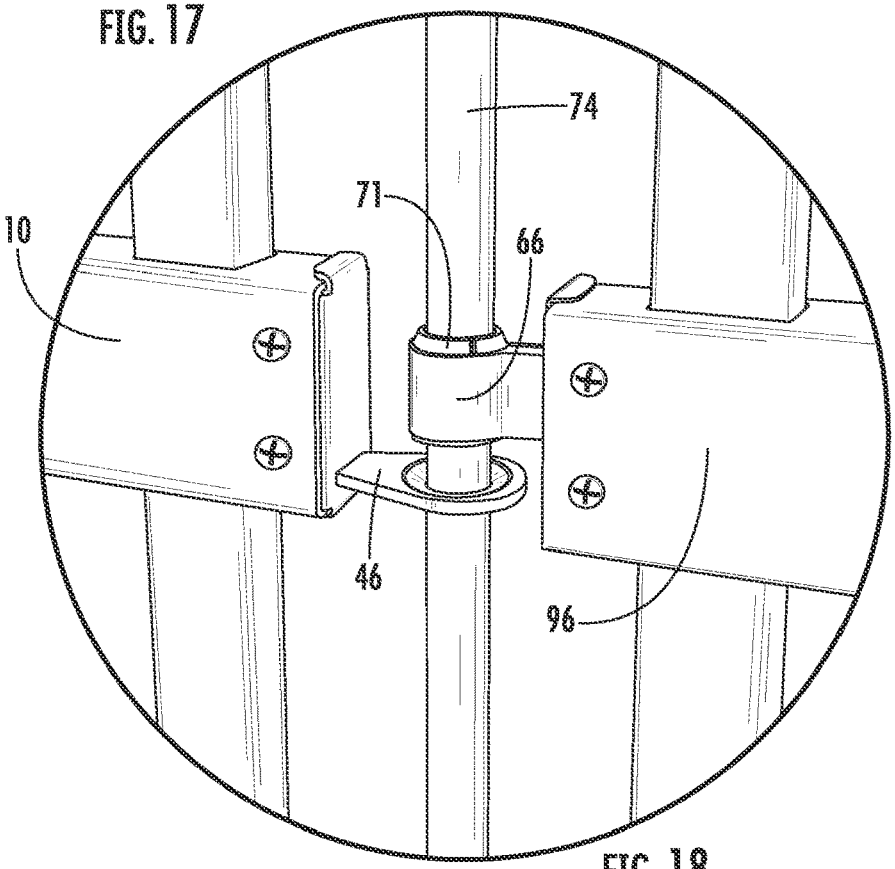
FIG. 18 is an enlarged perspective view of prefabricated modular fencing with advantageously-shaped connectors in accordance with an embodiment of the present invention.
Figure 19:
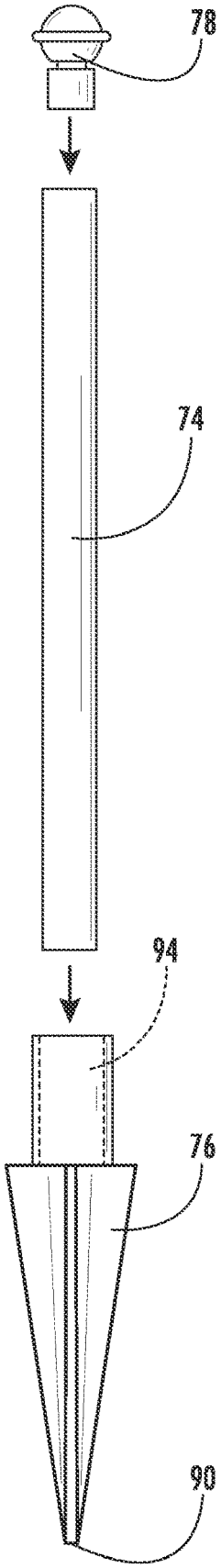
FIG. 19 is an elevation view of an embodiment of a post and a stake of prefabricated modular fencing with advantageously-shaped connectors in accordance with the present invention.
Figure 20:
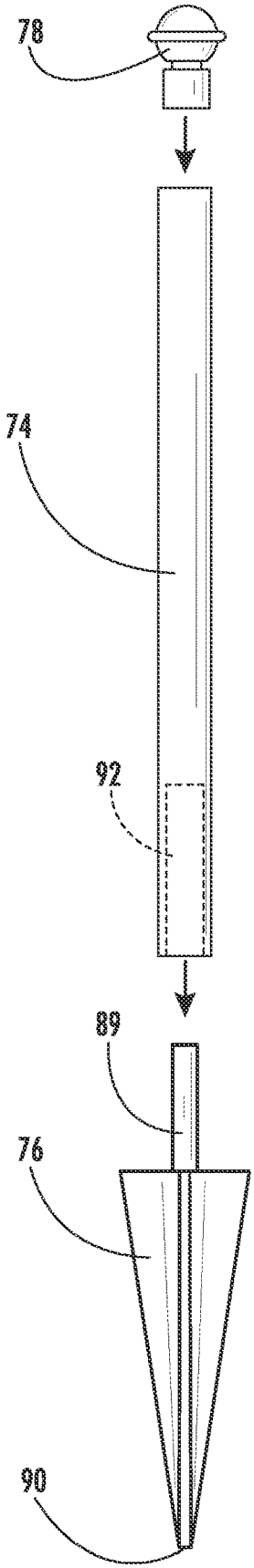
FIG. 20 is an elevation view of an embodiment of a post and a stake of prefabricated modular fencing with advantageously-shaped connectors in accordance with the present invention.

FIGS. 19 and 20 illustrate different embodiments of post 74 and stake 76. Post 74 has been sized so as to fit within and through the bore 54 of second connector 48 and fourth connector 52 (FIG. 17) and first connector 46 and second gate ring 66 (FIG. 18). FIG. 19 illustrates stake 76 including second socket 94, configured to receive the lower end of post 74. Stake 76 includes point 90, to facilitate driving stake 76 into the ground. Finial 78 is illustrated as an aesthetic element on post 74 opposite the end to be attached to stake 76. FIG. 20 illustrates an embodiment of a stake 76 including projection 89, configured to be inserted into first socket 92 at the lower end of an embodiment of a post 74.

In FIGS. 19 and 20, finial 78 is illustrated to include a male lower portion that fits within a female aspect at the upper end of post 74. However, other embodiments may be practiced (not shown). For example, finial 78 may comprise an aesthetic element that is spherical; an aperture may be created in the bottom of the sphere, for receipt therein of the upper end of post 74. Still further, a ring or washer may be affixed around the aperture (not shown), by weldment or otherwise, the ring or washer then being affixed to the upper end of post 74.

Figure 21:
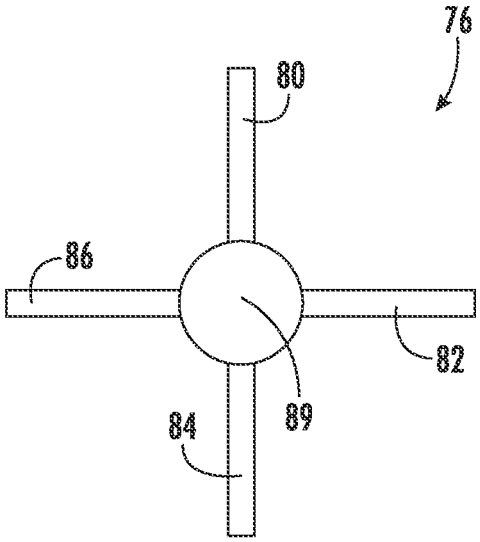
FIG. 21 is top plan view of an embodiment of a stake of prefabricated modular fencing with advantageously-shaped connectors in accordance with the present invention.
Figure 22:
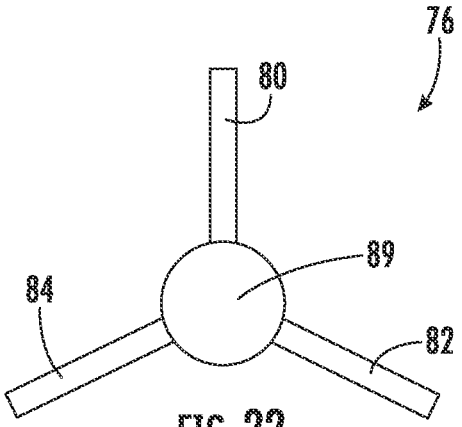
FIG. 22 is top plan view of an embodiment of a stake of prefabricated modular fencing with advantageously-shaped connectors in accordance with the present invention.
Figure 23:
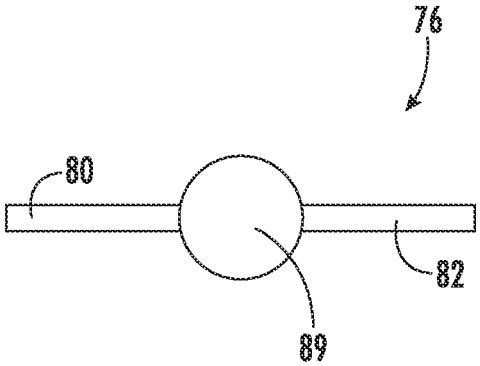
FIG. 23 is top plan view of an embodiment of a stake of prefabricated modular fencing with advantageously-shaped connectors in accordance with the present invention.

FIGS. 21, 22, and 23, illustrate alternative embodiments of stake 76. The stake 76 illustrated in FIG. 21 includes first stake blade 80, second stake blade 82, third stake blade 84, and fourth stake blade 86, all extending outwardly from projection 89. The stake 76 illustrated in FIG. 22 includes first stake blade 80, second stake blade 82, and third stake blade 84, all extending outwardly from projection 89. The stake 76 illustrated in FIG. 23 includes first stake blade 80 and second stake blade 82, both extending outwardly from projection 89.

Figure 2:
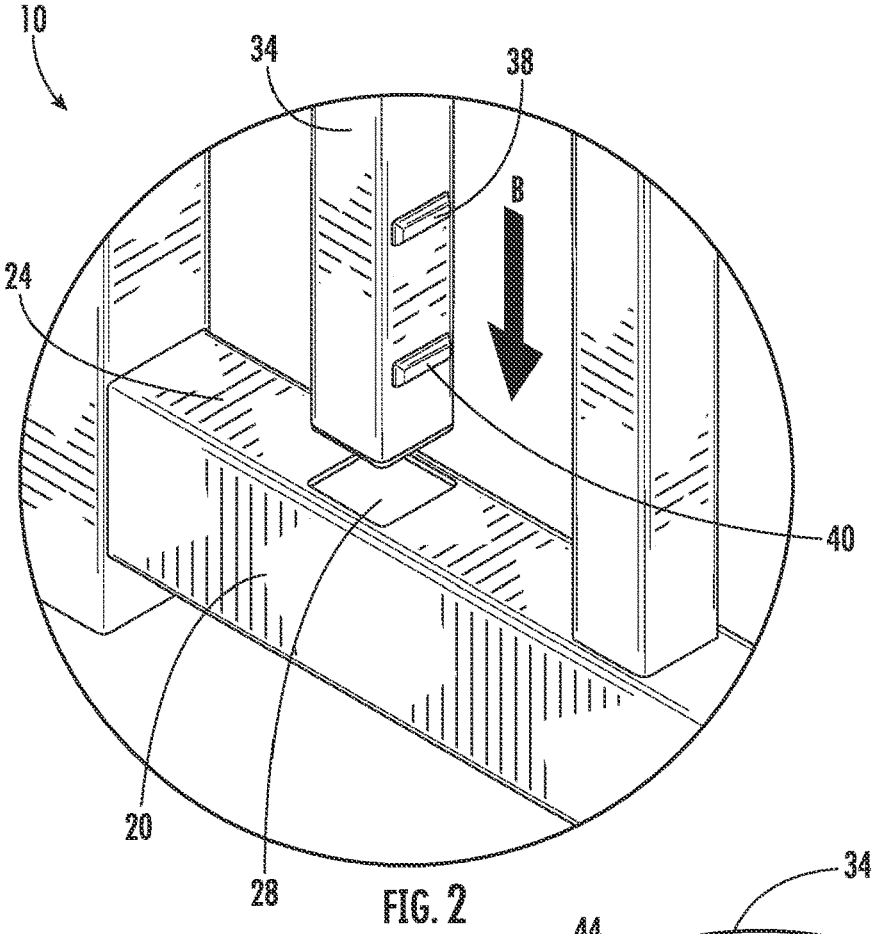
FIG. 2 is an enlarged operational illustration of prefabricated modular fencing with advantageously-shaped connectors in accordance with an embodiment of the present invention.
Figure 3:
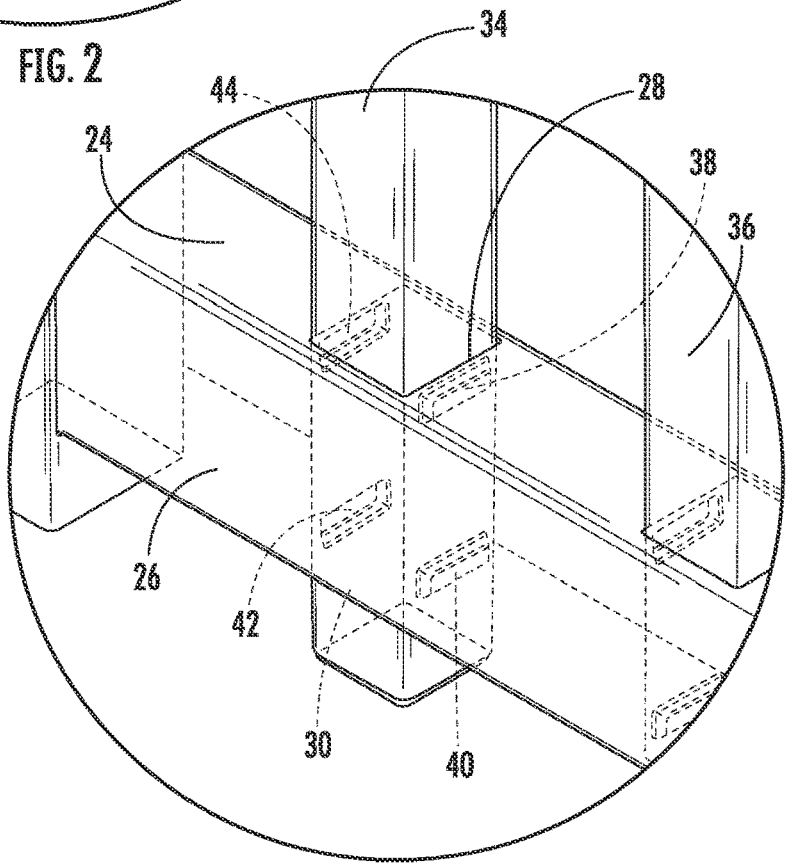
FIG. 3 is an enlarged perspective view illustrating inner construction of prefabricated modular fencing with advantageously-shaped connectors in accordance with an embodiment of the present invention, with certain features shown in phantom.

FIGS. 2 and 3 illustrate assembly of a vinyl first panel 10 of an embodiment of the present invention. Second rail 20 includes a first aperture 28 in upper surface 24. First picket 34 includes first prominence 38 and second prominence 40 and, in some embodiments such as that illustrated in FIG. 3, opposing third prominence 42 and fourth prominence 44. First aperture 28 is sized to receive first picket 34, but the dimensions of first aperture 28 may expand or stretch temporarily, due to the flexibility of the material, to allow passage of first prominence 38, second prominence 40, third prominence 42, and fourth prominence 44. Once such prominences 38, 40, 42, and 44 have passed the opening of first aperture 28, first aperture 28, owing to the flexibility of the material, returns to is non-expanded, non-stretched dimensions, holding first picket 34 within second rail 20, as illustrated in FIG. 3. In some embodiments (not illustrated), the lower end of first picket 34 may not extend past lower surface 26 of second rail 20; in other embodiments, such as that illustrated in FIG. 3, the lower end of first picket 34 may extend through second aperture 30 in lower surface 26 of second rail 20. Similarly to what is disclosed above as to assembly of first picket 34 with second rail 20, first picket 34 may likewise be assembled with a first rail 18 and, in certain configurations, with a third rail 22, first picket 34 being provided with additional prominences similar to or alike with first prominence 38, second prominence 40, third prominence 42, and/or fourth prominence 44, and first rail 18 (and, if applicable, third rail 22) including apertures similar to or alike with first aperture 28 and/or second aperture 30.

For the embodiment illustrated in FIGS. 2 and 3, the prominences, such as first prominence 38, second prominence 40, third prominence 42, and fourth prominence 44, may be formed on the surfaces of the picket, such as first picket 34, during manufacture of the picket, such as by adding additional material to the surface to create the prominences. In other embodiments (not shown), each picket, such as first picket 34, may have one or more prominences that are adjoining cuts on three sides, two of the cuts being parallel to one another and those two cuts being perpendicular to the third cut that adjoins the first two cuts, and then are pushed outward, leaving the uncut fourth side to act as a living hinge. The cuts may be made in opposing directions: the upper prominence, such as first prominence 38, may be made in an inverted U-shape and then pushed outward using the uncut portion between the legs of the inverted U-shape as a living hinge; the lower prominence, such as second prominence 40, may be a U-shape cut and likewise pushed outward using the uncut portion between the legs of the U-shape as a living hinge. Such a configuration creates opposing prominences that, when inserted into a rail such as second rail 20, lock the picket within the rail from either pushing up or down.

FIG. 18 illustrates the joinder of a first gate panel 96 to a first panel 10, with a first connector 46 carried by first panel 10 and a second gate ring 66 carried by first gate panel 96, post 74 disposed through first connector 46 and second gate ring 66. As illustrated in FIG. 18, in some applications it may be desirable to including a bushing 71 within the bore 54 of a gate ring, such as second gate ring 66, for ease of operation, for sizing, or for other advantages.

Figure 8:
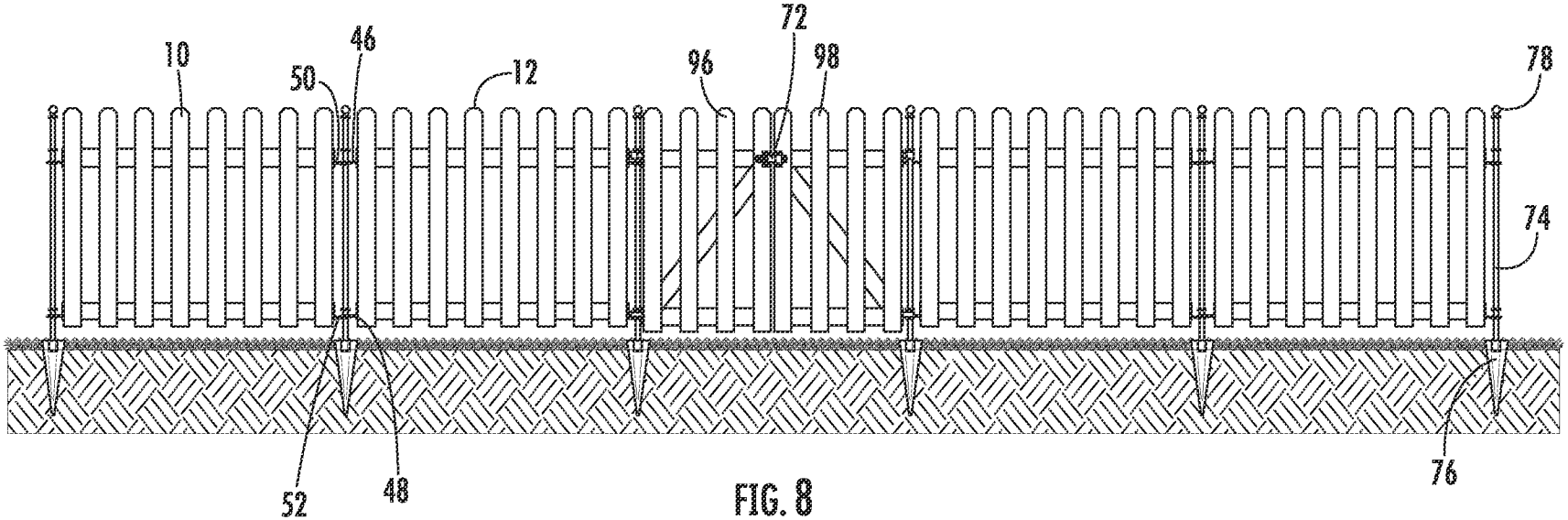
FIG. 8 is an elevation view of prefabricated modular fencing with advantageously-shaped connectors in accordance with an embodiment of the present invention.

FIG. 8 illustrates prefabricated modular fencing with advantageously-shaped connectors, as installed in an application. Plural posts 74, connected to stakes 76 and finials 78, have been disposed through plural first connectors 46 interfitted with third connectors 50 and through plural second connectors 48 interfitted with fourth connectors 52. The prefabricated modular fencing includes first gate panel 96 and second gate panel 98, along with gate latch 72. Each of the adjacent panels 10, 12, are aligned and even across their tops and bottoms. More particularly, each first connector **46*a* and second connector 48*a* have been dimensioned at such a distance from the top and bottom of each first panel 10, and each third connector 50*b* and fourth connector 52*b* have been dimensioned at such a distance from the top and bottom of each second panel 12 that, with each first connector 46*a* and second connector 48*a* interfitted with each third connector 50*b* and fourth connector 52*b*, respectively, each first panel 10 and second panel 12 are aligned and even once first panel 10 and second panel 12 were joined—the topmost aspects of each first panel 10 and second panel 12 form a straight line that is parallel to the horizon, as illustrated in FIG. 8**.

Embodiments of the prefabricated modular fencing disclosed herein may be constructed in many ways. One example of such construction includes the steps of providing a first and a second fencing panel 10, 12, respectively, with each panel having opposed side ends 14, 16. Upper and lower connectors 46, 48, respectively, are carried outboard the first end 14 and upper and lower connectors 50, 52, respectively, are carried outboard the second end 16. Each of the connectors 46, 48, 50, and 52 have an upper side and an opposing lower side, with one of a concavity 57 and a convexity 59 on the upper side and the other of a concavity 57 and a convexity 59 on the lower side, and defining a bore extending through each connector. The first panel 10 may be disposed upright at a first tentative final location. The second panel 20 may be disposed upright at a second tentative final location. The first panel 10 and the second panel 12 may be maintained in their respective upright positions by interfitting either the convexity 59 or the concavity 57 of connector 46 with its complement concavity 57 or convexity 59 or connector 50, and interfitting either the convexity 59 or the concavity 57 of connector 48 with its complement concavity 57 or convexity 59 or connector 52, thereby releasably connecting first panel 10 and second panel 12, with minimal or no support or bracing to the side of either first panel 10 or second panel 12 by slightly rotating first panel 10 relative to second panel 12 to provide an angle C between first panel 10 and second panel 12 that is not 180°. If the first and second tentative final locations are determined to be undesirable, for either or both of aesthetic or functional reasons, either or both locations may be adjusted to respective definite final locations, with minimal or no support or bracing to the side of either first panel 10 or second panel 12. First panel 10 and second panel 12 thus also may preliminarily be held together without insertion of post 74, due to the interfitting of connectors 46, 50 and 48, 52. The process of adjusting the tentative final locations of first panel 10 and second panel 12 may be repeated multiple times until satisfactory final positions are achieved. Stake 76 may then be driven into the ground at the location by the interfitting either the convexity 59 or the concavity 57 of connector 46 with its complement concavity 57 or convexity 59 or connector 50, and interfitting either the convexity 59 or the concavity 57 of connector 48 with its complement concavity 57 or convexity 59 or connector 52, and post 74 may then be inserted through the bore 54 of interfitted connectors 46 with 50 and 48 with 52, and attached to stake 76.

Thus, a new prefabricated modular fencing with advantageously-shaped connectors has been provided that allows the standing of each fencing panel vertically in a tentative final location before deciding that, indeed, such location should be finalized by securing the fencing to the ground or, instead, deciding that further location adjustment is needed. The prefabricated fencing panels can be stood vertically on their own without propping up with rods or boards from the sides or clamped together. The prefabricated fencing panels are able to be interfitted preliminarily with one another in a vertical orientation with minimal propping, and to be able to be disengaged from one another and moved during installation if the location of the fencing run is determined to need change.

Detailed embodiments of the present invention are disclosed herein; however, while various embodiments and examples of this invention have been described above, these descriptions are given for purposes of illustration and explanation, and not limitation. Variations, changes, modifications, and departures from the systems and methods disclosed above may be adopted without departure from the spirit and scope of this invention. Moreover, specific structural and functional details disclosed herein are not to be interpreted as limiting, but merely as a basis for the claims and as a representative basis for teaching one skilled in the art to variously employ the present invention. It will be apparent to those skilled in the art that many changes and substitutions may be made to the foregoing description of preferred embodiments and examples without departing from the spirit and scope of the present invention, which is defined by the appended claims.

Further, the purpose of the Abstract is to enable the various patent offices and the public generally, and especially the scientists, engineers, and practitioners in the art who are not familiar with patent or legal terms or phraseology, to determine quickly from a cursory inspection the nature and essence of the technical disclosure of the application. The Abstract is not intended to be limiting as to the scope of the invention in any way.

The invention claimed is:

1. A prefabricated modular fencing, comprising:
- a fence panel, the panel having a first end and an opposing second end;
- a first connector, the first connector residing outboard the fence panel at the first end;
- a second connector, the second connector residing outboard the fence panel at the second end;
- each of the first and second connectors:
  - having an upper side and an opposing lower side;
  - having one of a concavity and a convexity on the upper side and the other of a concavity and a convexity on the lower side;
  - the concavity being sized complementary to the convexity; and
  - defining therethrough a bore, the bore defined through the concavity and convexity, the bore sized to receive a post.

2. The prefabricated modular fencing of claim 1, in which each concavity is a smooth frustoconical.

3. The prefabricated modular fencing of claim 1, further including a post interfitted through the bore of the first connector and attached at one end to a pointed stake.

4. The prefabricated modular fencing of claim 1, further including a post and a stake, the stake including a socket, the socket sized to receive therein the lower end of the post.

5. The prefabricated modular fencing of claim 1, further including a post and a stake, the stake including an upwardly extending projection, the post configured to receive within its lower end the upwardly extending projection.

6. A prefabricated modular fencing kit, comprising:
- a fencing panel, the fencing panel having a first end and an opposing second end;
- first and second connectors residing at the first end at a first distance apart;
- third and fourth connectors residing at the second end at a second distance apart;
- each of the first, second, third, and fourth connectors having an upper side and an opposed lower side;
- each upper side being one of a concavity and a convexity and each lower side being the other of a concavity and a convexity;
- each of the concavities defining therethrough a bore having a minimum width; and
- a post, the post having a length greater than the first and second distances and having a maximum width that is smaller than the minimum width.

7. The prefabricated modular fencing kit of claim 6, in which convexity of the first connector is complementary to the concavity of the third connector, and the convexity of the second connector is complementary to the concavity of the fourth connector.

8. The prefabricated modular fencing kit of claim 6, in which convexity of the first, second, third, and fourth connectors is identical and is complementary to the concavity of the first, second, third, and fourth connectors.

9. The prefabricated modular fencing kit of claim 6, in which the first and second ends terminate at a bottom, the first connector resides lower than the second connector and a third distance from the bottom, the third connector resides lower than the fourth connector and a fourth distance from the bottom, the third distance is greater than the fourth distance, and the first distance is equal to the second distance.

10. The prefabricated modular fencing kit of claim 6, in which the concavities and convexities are frustoconical.

11. The prefabricated modular fencing kit of claim 6, in which the concavities and convexities include facets.

12. The prefabricated modular fencing kit of claim 6, further including a stake separate from the post.

13. The prefabricated modular fencing kit of claim 6, further including a stake separate from the post, the stake including a socket configured for receipt therein of the post.

14. The prefabricated modular fencing kit of claim 6, further including a stake separate from the post, the stake including a post receiver, the post including a socket therein for receipt of the post receiver.

15. The prefabricated modular fencing of claim 6, further including a post and a stake, the stake including a socket, the socket sized to receive therein the lower end of the post.

16. The prefabricated modular fencing of claim 6, further including a post and a stake, the stake including an upwardly extending projection, the post configured to receive within its lower end the upwardly extending projection.

17. A method of constructing a fence, comprising the steps of:

providing the prefabricated modular fencing kit of claim 6;

providing a second fencing panel, the second fencing panel having:

a third end and an opposing fourth end;

fifth and sixth connectors residing at the third end at a first distance apart;

each of the fifth and sixth connectors having an upper side and an opposed lower side;

each upper side being one of a concavity and a convexity and each lower side being the other of a concavity and a convexity;

each of the concavities defining therethrough a bore having the minimum width; and disposing the fencing panel of claim 6 upright at a first location;

disposing the second fencing panel upright at a second location adjacent to the first location;

maintaining the fencing panel of claim 6 and the second fencing panel in their respective upright positions by interfitting the convexity of the first connector into the concavity of the fifth connector and by interfitting the convexity of the second connector into the concavity of the sixth connector; and inserting the post through the bores of the first, second, fifth, and sixth connectors.

18. The method of constructing a fence of claim 17, in which the second fencing panel is identical to the fencing panel of claim 6.

19. A prefabricated modular fencing system, comprising:

a first fence panel having first and second side ends, the first side end carrying a first connector and a second connector, the first and second connectors residing outboard of the first fence panel;

a second fence panel having third and fourth side ends, the third side end carrying a third connector and a fourth connector residing outboard of the second fence panel;

the first, second, third, and fourth connectors:

having upper sides defining one of a concavity and a convexity and having lower sides defining the other of a concavity and a convexity;

defining a bore within each convexity;

the convexity of the third connector being complementary with and residing within the concavity of the first connector, and the convexity of the fourth connector being complementary with and residing within the concavity of the second connector; and a post disposed through the bores of the first, second, third, and fourth connectors.

20. The prefabricated modular fencing system of claim 19, in which the concavity is a negative frustoconical.

21. The prefabricated modular fencing system of claim 19, further including a stake having a lower end and an upper end, the upper end carrying a post receiver.

22. The prefabricated modular fencing system of claim 19, further including a stake having a lower end and an upper end, the upper end carrying a post receiver configured to insert into the post.

23. The prefabricated modular fencing system of claim 19, further including a stake having a lower end and an upper end, the upper end carrying a post receiver with an aperture, the aperture configured to receive within it the post.

24. A method of constructing a fence, comprising the steps of:

providing a first and second fencing panel, each panel having:

opposed side ends;

upper and lower connectors residing outboard at each side end;

each of the connectors having an upper side and an opposing lower side, with one of a concavity and a convexity on the upper side and the other of a concavity and a convexity on the lower side, and defining a bore through each concavity;

disposing the first fencing panel upright at a first location;

disposing the second fencing panel upright at a second location adjacent to the first location;

maintaining the first fencing panel and the second fencing panel in their respective upright positions by interfitting the convexity and concavity of adjacent connectors;

inserting the post through the bores of the interfitted connectors.

* * * * *